US008483597B2

(12) United States Patent
Mimbu et al.

(10) Patent No.: US 8,483,597 B2
(45) Date of Patent: Jul. 9, 2013

(54) TRANSFER ASSEMBLY AND IMAGE FORMING APPARATUS USING SAME

(75) Inventors: Ryuuichi Mimbu, Kanagawa (JP); Kenji Sengoku, Kanagawa (JP); Junpei Fujita, Kanagawa (JP); Osamu Ichihashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 302 days.

(21) Appl. No.: 12/974,655

(22) Filed: Dec. 21, 2010

(65) Prior Publication Data

US 2011/0158690 A1 Jun. 30, 2011

(30) Foreign Application Priority Data

Dec. 24, 2009 (JP) ..... 2009-292927

(51) Int. Cl.
*G03G 15/08* (2006.01)

(52) U.S. Cl.
USPC ..... 399/121

(58) Field of Classification Search
USPC ..... 399/66, 121
See application file for complete search history.

(56) References Cited

U.S. PATENT DOCUMENTS

| | | | | |
|---|---|---|---|---|
| 6,901,234 | B2 | 5/2005 | Ogiyama et al. | |
| 6,947,693 | B2 | 9/2005 | Kamiya et al. | |
| 7,502,583 | B2 | 3/2009 | Sawai et al. | |
| 7,532,370 | B2 | 5/2009 | Kudo et al. | |
| 7,742,721 | B2 | 6/2010 | Mimbu | |
| 7,773,928 | B2 | 8/2010 | Ogiyama et al. | |
| 2006/0062593 | A1 * | 3/2006 | Takahashi | 399/121 |
| 2008/0232867 | A1 | 9/2008 | Minbu et al. | |
| 2009/0060611 | A1 | 3/2009 | Minbu | |
| 2009/0142083 | A1 | 6/2009 | Minbu | |
| 2009/0279927 | A1 | 11/2009 | Fujita | |
| 2010/0061741 | A1 | 3/2010 | Minbu | |
| 2010/0067952 | A1 | 3/2010 | Fujita et al. | |
| 2010/0098465 | A1 * | 4/2010 | Saito | 399/297 |
| 2010/0142985 | A1 | 6/2010 | Minbe et al. | |
| 2010/0221029 | A1 | 9/2010 | Minbu et al. | |
| 2010/0232845 | A1 * | 9/2010 | Kamijo et al. | 399/313 |
| 2010/0272478 | A1 | 10/2010 | Ichihashi | |

FOREIGN PATENT DOCUMENTS

| | | |
|---|---|---|
| JP | 6-274051 | 9/1994 |
| JP | 10-83124 | 3/1998 |
| JP | 2009-58896 | 3/2009 |
| JP | 2010-134142 | 6/2010 |
| JP | 2010-204259 | 9/2010 |

* cited by examiner

*Primary Examiner* — Watler L Lindsay, Jr.
*Assistant Examiner* — Frederick Wenderoth
(74) *Attorney, Agent, or Firm* — Oblon, Spivak, McClelland, Maier & Neustadt, L.L.P.

(57) ABSTRACT

A transfer assembly includes a counter member having a contact face, an engagement/disengagement unit to engage and disengage the image carrying face of image carrying member and the contact face of counter member using a cam, a pressure device to apply force to a transfer nip between the image carrying face and contact face, and a recording medium feed device to feed the recording medium to the transfer nip. When the cam is at a first rotation position, the image carrying face and contact face are separated, and when the cam is at a second rotation position, the image carrying face and contact face contact. Before the recording medium enters the transfer nip, the cam rotates from the first rotation position toward the second rotation position. After the recording medium enters the transfer nip, the cam is at the second rotation position to press the image carrying face with the contact face.

9 Claims, 11 Drawing Sheets

TRANSFER ASSEMBLY AND IMAGE FORMING APPARATUS USING SAME

CROSS-REFERENCE TO RELATED APPLICATIONS

This application claims priority to Japanese Patent Application No. 2009-292927, filed on Dec. 24, 2009 in the Japan Patent Office, which is incorporated by reference herein in its entirety.

BACKGROUND OF THE INVENTION

1. Field of the Invention

The present invention relates to a transfer assembly to transfer an image from an image carrying member to a transfer member such as a recording medium at a transfer nip, set between the image carrying member and a recording medium, and an image forming apparatus using the transfer assembly.

2. Description of the Background Art

Typically, an image forming apparatus includes an image carrying member and a counter member opposing the image carrying member. The image carrying member and counter member form a transfer nip therebetween, at which an image can be transferred from the image carrying member to a recording medium such as a sheet of paper, etc. Specifically, the counter member may be pressed toward the image carrying member using a force of a pressure device to contact the image carrying member to form the transfer nip. In addition, the counter member can be separated from the image carrying member using a separation device as required. When a recording medium is a thick sheet such as a thick paper, shock jitter may occur at the transfer nip, and banding (i.e., uneven image concentration appearing as lines on an image) may occur. Such banding phenomenon may occur when the thick paper enters the transfer nip, because the image carrying member may receive a greater load abruptly or within a short time, and as a result the image carrying member experiences a moment of steep drop in line speed.

JP-H10-83124-A discloses a method of preventing shock jitter, in which a transfer roller is used as the counter member. The transfer roller includes a cylindrical roll and a shaft projecting from both end of the roll, and the roll and shaft rotate integrally. Further, a rotatable cam disposed at each end of the shaft can rotate freely at each end of the shaft without force transmission between the cam and the shaft.

The rotatable cam, which can rotate freely on an outer face of the shaft, has a convex portion at a given rotation angle position abut-able against an axial end portion of an image carrying member such as a photoconductor. With such abutting action, the transfer roller, pressed toward the photoconductor by a pressure device, can be forcibly moved away from the photoconductor against the force, by which a shaft-to-shaft distance between the photoconductor and transfer roller can be adjusted. For example, when thick paper is used as the recording medium, the transfer roller can be forcibly moved away from the photoconductor by the rotatable cam to decrease a transfer pressure by enlarging the shaft-to-shaft distance (i.e., separating the transfer roller from the photoconductor). With such a configuration, an abrupt load increase at the photoconductor, which may occur when thick paper enters the transfer nip, can be suppressed or prevented. However, although an abrupt load increase to the photoconductor can be prevented or suppressed by setting the shaft-to-shaft distance wider, as a side effect an effective transfer pressure may not be set, and thereby transfer failure may occur.

JP-H06-274051-A discloses an image forming apparatus in which a transfer roller can be separated from a photoconductor by driving a rotatable cam by activating a solenoid before a thick sheet of paper, used as a recording medium, enters a transfer nip, in which a minute gap may be set between the transfer roller and photoconductor to prevent the occurrence of shock jitter. Then, right after the front edge of the thick paper enters the minute gap, the solenoid is deactivated to cancel a forced separation of transfer roller so that the transfer roller can be pressed toward the photoconductor by a force of a spring used as a pressure device. With such a configuration, the transfer roller is separated from the image carrying member until a recording medium such as a thick sheet of paper enters the transfer nip, and thereby a load increase at the image carrying member when the recording medium enters the transfer nip can be suppressed. However, when separation of the transfer roller is canceled, the image carrying member, the recording medium, and the transfer roller may instantly collide with each other due to the force of the pressure device, thereby causing a load increase or vibration at the image carrying member with possible image failure (or image deterioration) as a result.

SUMMARY

In one aspect of the invention, a transfer assembly is devised. The transfer assembly includes a counter member, an engagement/disengagement unit, a pressure device, a recording medium feed device, and a transfer device. The counter member, disposed opposite an image carrying face of an image carrying member, has a contact face to contact to a recording medium. The engagement/disengagement unit engages and disengages the image carrying face of the image carrying member and the contact face of the counter member. The engagement/disengagement unit includes a cam and a cam driver to drive and rotate the cam. The pressure device applies a force to a transfer nip defined between the image carrying face of the image carrying member and the contact face of the counter member in a state in which the image carrying face of the image carrying member engages the contact face of the counter member. The recording medium feed device feeds the recording medium to the transfer nip. The transfer device transfers an image from the image carrying member to the recording medium sandwiched at the transfer nip. The cam has an outer face having a given shape so that when the cam is at a first rotation position, the image carrying face of the image carrying member and the contact face of the counter member are separated, and when the cam is at a second rotation position, the image carrying face of the image carrying member and the contact face of the counter member contact each other. Before the recording medium, fed from the recording medium feed device, enters the transfer nip, the cam is started to rotate from the first rotation position toward the second rotation position at a given speed while increasing a rotation speed of the cam. After the recording medium enters the transfer nip, the cam is at the second rotation position to press the image carrying face of the image carrying member with the contact face of the counter member, and the force of the pressure device is applied to the transfer nip as a transfer pressure.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
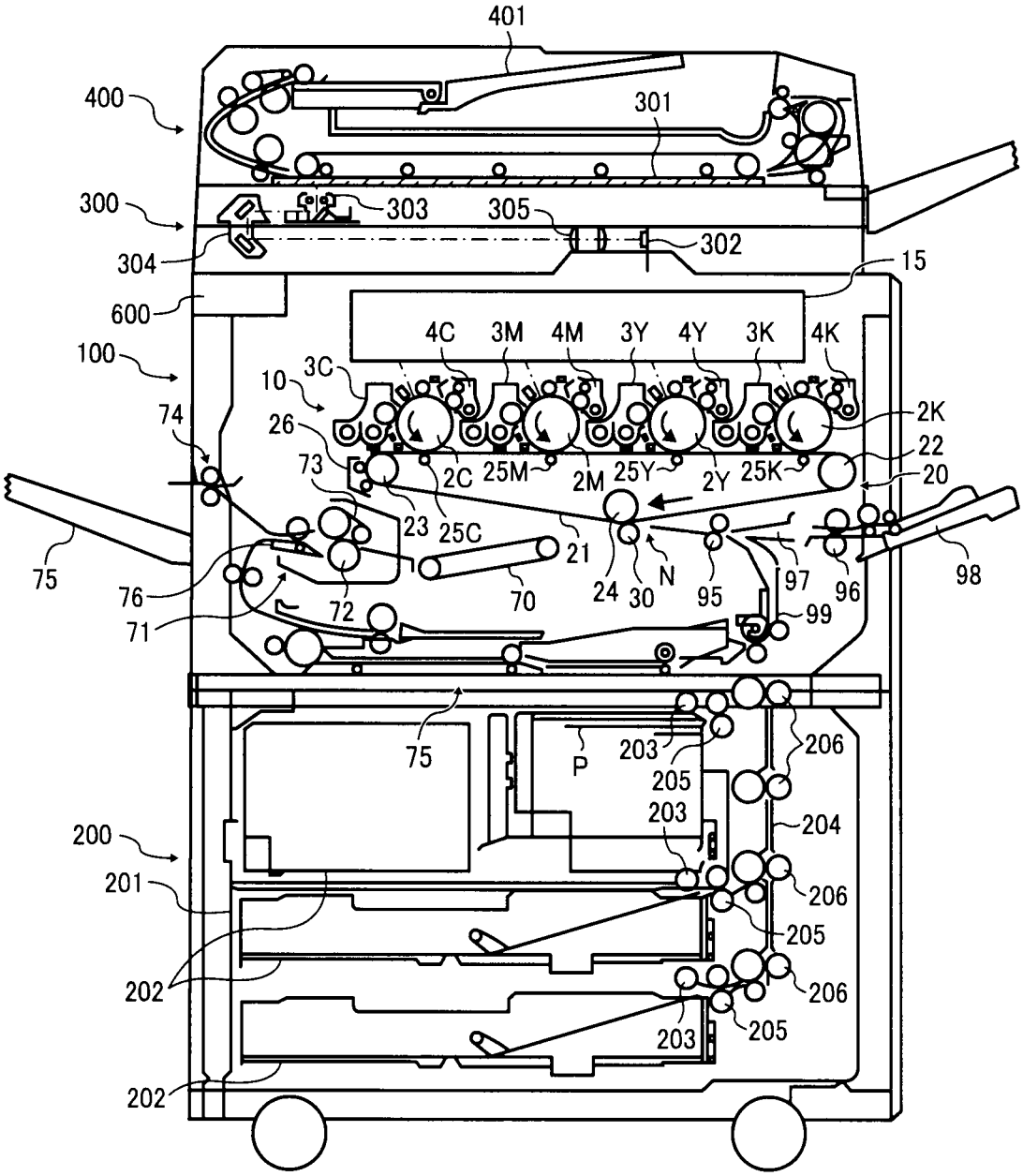
FIG. 1 shows a schematic configuration of an image forming apparatus according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner. Referring now to the drawings, an image forming apparatus according to example embodiment is described hereinafter.

FIG. 1 shows an image forming apparatus, which may be a tandem type color copier, but not limited thereto. The image forming apparatus may include a printing unit 100, a recording media storage/supply 200 used as sheet storage and sheet supply, a scanner 300, and an automatic document feeder (ADF) 400, for example. The scanner 300 may be disposed on the printing unit 100, and the ADF 400 may be disposed on the scanner 300. A description is now given to an overall configuration and operation of image forming apparatus at first, and then a description of specific configuration and operation of units is given.

The printing unit 100 may include an intermediate transfer belt 21 used as an image carrying member and intermediate transfer member, which may be shaped into, for example, an endless belt. The intermediate transfer belt 21 may be extended by a plurality of rolling members such as a drive roller 22 and a driven roller 23, and a support member such as for example a support roller used as a secondary transfer-support roller 24. The intermediate transfer belt 21 may be extended as an inverted triangle when viewed from one side of image forming apparatus as shown in FIG. 1. The intermediate transfer belt 21, extended by the drive roller 22, the driven roller 23, and the secondary transfer-support roller 24, can be moved endlessly, for example, in a clockwise direction in FIG. 1 when the drive roller 22 is rotated by driving force. Image forming units 1C, 1M, 1Y, 1K to form toner images of C (cyan), M (magenta), Y (yellow), K (black), respectively may be disposed in tandem over the intermediate transfer belt 21 along a belt-moving direction of the intermediate transfer belt 21.

Each of the image forming units 1C, 1M, 1Y, 1K may include photoconductors 2C, 2M, 2Y, 2K having drum shape used as image carrying member, the development units 3C, 3M, 3Y, 3K, and cleaning units 4C, 4M, 4Y, 4K for cleaning the photoconductors. Each of the photoconductors 2C, 2M, 2Y, 2K may contact the intermediate transfer belt 21 to form a primary transfer nip of C, M, Y, K, respectively, and each of the photoconductors 2C, 2M, 2Y, 2K can be rotated, for example, in a counter-clockwise direction FIG. 1 by using a driving force of driving unit. Each of the development units 3C, 3M, 3Y, 3K develops electrostatic latent images formed on each of the photoconductors 2C, 2M, 2Y, 2K using C, M, Y, K toner, respectively. After the photoconductors 2C, 2M, 2Y, 2K pass through the primary transfer nip, each of the cleaning units 4C, 4M, 4Y, 4K cleans toner remaining on the photoconductors 2C, 2M, 2Y, 2K after a transfer. In the image forming apparatus of example embodiment, a tandem-type image forming assembly 10 may be configured with the image forming units 1C, 1M, 1Y, 1K disposed along a belt-moving direction.

In the printing unit 100, an optical writing unit 15 may be disposed over the tandem-type image forming assembly 10. The optical writing unit 15 conducts an optical writing such as optically scanning the photoconductors 2C, 2M, 2Y, 2K to form electrostatic latent images on the surfaces of photoconductors 2C, 2M, 2Y, 2K, in which the photoconductors 2C, 2M, 2Y, 2K may be rotated in a counter-clockwise direction in FIG. 1 using a driving force, and the surface of photoconductor 2 is used as an image carrying face to carry a latent image and a developed toner image. Before conducting an optical writing, the surface of rotating photoconductors 2C, 2M, 2Y, 2K is uniformly charged by a charger disposed in the image forming units 1C, 1M, 1Y, 1K.

A transfer assembly 20 includes the intermediate transfer belt 21, and primary transfer rollers 25C, 25M, 25Y, and 25K inside a loop of the intermediate transfer belt 21. Each of the primary transfer rollers 25C, 25M, 25Y, and 25K can be pressed toward each of the photoconductors 2C, 2M, 2Y, 2K at the primary transfer nip for C, M, Y, K, respectively via the intermediate transfer belt 21.

Further, a secondary transfer roller 30, used as a counter member, may be disposed below the intermediate transfer belt 21. Specifically, the secondary transfer roller 30 is disposed at a position opposing the secondary transfer-support roller 24 via the intermediate transfer belt 21. The secondary transfer-support roller 24, used as a support member, may be disposed inside the intermediate transfer belt 21 (i.e., opposite of belt face 21*a* of intermediate transfer belt 21) to support and extend the intermediate transfer belt 21.

Figure 2:
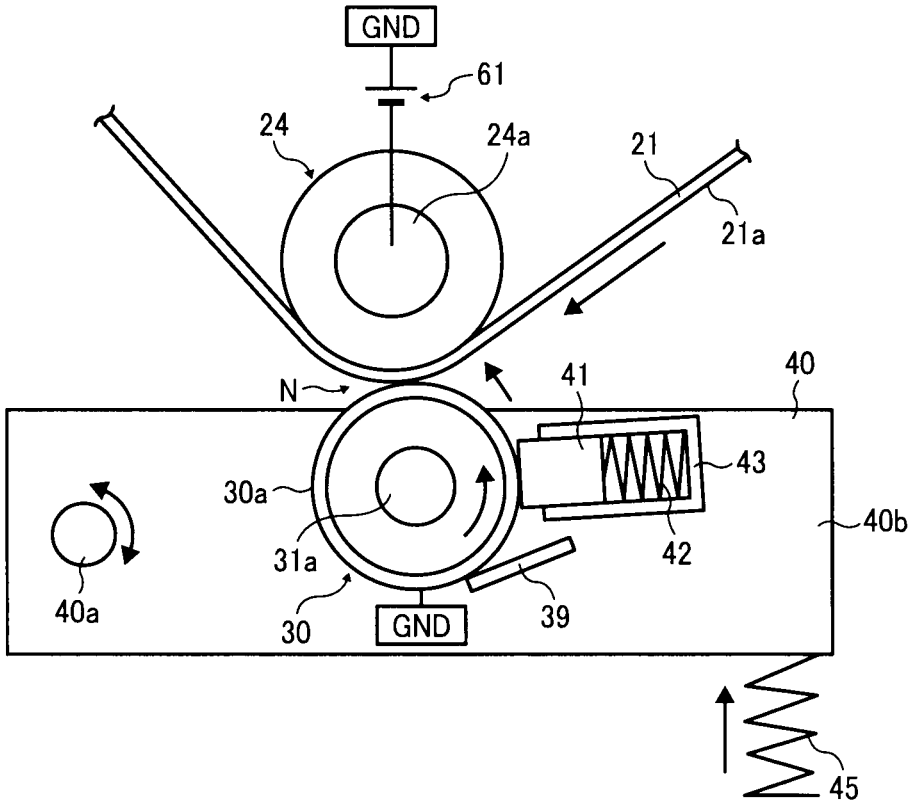
FIG. 2 shows an expanded cross-sectional view of transfer assembly.

As shown in FIG. 2, the secondary transfer roller 30 may contact the belt face 21*a* of intermediate transfer belt 21, used as image carrying face, to set a secondary transfer nip N, to which a recording medium P is fed or transported at a given timing. Toner image of each color formed on each photoconductor can be transferred onto the belt face 21*a* of intermediate transfer belt 21 at the above-described primary transfer nip, in which four color toner images may be superimposed and transferred onto the intermediate transfer belt 21. Then, toner image having superimposed four-color image can be secondary transferred to the recording medium P at the secondary transfer nip N with a one-time transfer action.

In the image forming apparatus, the scanner 300 scans image data or information of document placed on a contact glass 301 using a scan sensor 302, and transmits the scanned image information to a controller 600 of the printing unit 100. Based on the image information received from the scanner 300, the controller 600 controls a light source such as laser diode, light emitting diode (LED), or the like provided in the optical writing unit 15 of the printing unit 100 to emit optical writing beams for C, M, Y, K images as laser beams to optically scan the photoconductors 2C, 2M, 2Y, 2K, respectively. With such optical scanning process, an electrostatic latent image can be formed on the surface of each of the photoconductors 2C, 2M, 2Y, 2K, and such electrostatic latent images can be developed as C, M, Y, K toner images by conducting a development process.

In the image forming apparatus, the recording media storage/feeder 200 may include a sheet accommodation unit 201, sheet cassettes 202, sheet feed rollers 203, separation rollers 205, and transport rollers 206. The sheet cassettes 20 may be disposed with a stacked manner in the sheet accommodation unit 201. The sheet feed roller 203 is used to feed out the recording medium P from each of the sheet cassettes 202. The separation roller 205 separates the recording medium P fed from the sheet feed roller 203 one by one, and guides the recording medium P to a sheet feed route 204. The transport roller 206 transports the recording medium P to a sheet feed path 99 disposed in the printing unit 100.

In addition to the recording media storage/feeder 200, sheet can be also fed by a manual sheet feeding process using a manual sheet feed tray 98 and a separation roller 96. Recording media such as sheets placed on the manual sheet feed tray 98 can be separated and fed one by one to a manual sheet feed path 97 using the separation roller 96. In the printing unit 100, the manual sheet feed path 97 is converged to the sheet feed path 99.

Further, a registration roller 95, composed of a pair of rollers, is disposed nearby an end of the sheet feed path 99, and the registration roller 95 can be used as a recording medium feed device to feed the recording medium P to the secondary transfer nip N. Specifically, the recording medium P transported along the sheet feed path 99 is sandwiched and stopped by the pair of rollers of registration roller 95 for some time, and then fed to the secondary transfer nip N at a given timing.

When to copy an image such as color image using the image forming apparatus, a document is set on a document stand 401 of ADF 400, or a document is set directly on the contact glass 301 of the scanner 300 by opening and closing the ADF 400, and then a start switch is pressed. When a document is set on the ADF 400, the document is transported onto the contact glass 301. Then, the scanner 300 is driven to start a scanning process, in which a first carriage 303 and a second carriage 304 start to move along a document face. Light emitted from a light source disposed in the first carriage 303 reflects on the document face, and such reflection light is deflected to the second carriage 304. The reflection light is further deflected by a mirror disposed in the second carriage 304, and then enters the scan sensor 302 through a focus lens 305. With such processing, the content of document is scanned.

When the scanned image information is transmitted from the scanner 300 to the printing unit 100, a recording medium having a size matched to the scanned image information may be fed to the sheet feed path 99. Further, the intermediate transfer belt 21 may be moved endlessly in a clockwise direction in FIG. 1 by rotating the drive roller 22 using a drive motor.

Further, the photoconductors 2C, 2M, 2Y, 2K in the image forming units 1C, 1M, 1Y, 1K are started to rotate, and then a uniform-charging process, an optical writing process, and a development process are conducted on each of the photoconductors 2C, 2M, 2Y, 2K. By conducting such processes, toner images of C, M, Y, K formed on the surface of the photoconductors 2C, 2M, 2Y, 2K are primary transferred onto the intermediate transfer belt 21 at the primary transfer nip of C, M, Y, K, in which toner images of C, M, Y, K are sequentially superimposed onto the intermediate transfer belt 21 to form a toner image superimposed of four color image.

In the recording media storage/feeder 200, one of the sheet feed rollers 203 is selectively rotated in view of a size of recording medium to be used, and one type of recording medium P is fed out from one of the sheet cassettes 202. The recording medium P is then separated by the separation roller 205 one by one and guided to the sheet feed route 204. The recording medium P is further transported to the sheet feed path 99 in the printing unit 100 via the transport roller 206.

Further, when the manual sheet feed tray 98 is used, a sheet feed roller of the tray 98 is rotated, recording media placed on the tray 98 is separated by the separation roller 96, and then a recording medium is fed to an end of the sheet feed path 99 via the manual sheet feed path 97. At the end of sheet feed path 99, the front edge of recording medium P is abutted to the registration roller 95 and stopped. Then, the registration roller 95 is rotated at a timing synchronized with a timing of superimposing toner images of four color images on the intermediate transfer belt 21, and the recording medium P is fed into the secondary transfer nip N and contacted to the superimposed toner image. Then, the superimposed toner image is secondarily transferred to the recording medium P with a one-time transfer action by transfer pressure and a transfer electric field formed by applying a secondary transfer bias voltage.

After conducting a secondary transfer of transferring the superimposed toner image to the recording medium P at the secondary transfer nip N, the recording medium P is transported to a fusing unit 71 disposed in the printing unit 100 using a sheet transport belt 70. In the fusing unit 71, the recording medium P is sandwiched at a fusing nip set between a pressure roller 72 and a fusing belt 73 so that the superimposed toner image is fused on the recording medium P by applying pressure and heat. Then, the recording medium P having a fused image is ejected and stacked onto a sheet ejection tray 75 via sheet ejection rollers 74.

When an image is to be formed on another face (or back face) of the recording medium P, the recording medium P ejected from the fusing unit 71 is transported to a inverting unit 75 using a switching claw 76, which can change a sheet route. Then, the faces of recording medium P are inverted by the inverting unit 75 and transported to the registration roller 95 again. Then, an image is transferred at the secondary transfer nip N and fused at the fusing unit 71 on the recording medium P, and then the recording medium P is ejected and stacked on the sheet ejection tray 75.

After passing through the recording medium P at the secondary transfer nip N, a belt cleaning unit 26 cleans the belt face 21*a* of intermediate transfer belt 21. The belt cleaning unit 26 may be disposed at a position close to the primary transfer nip of cyan image and before the intermediate transfer belt 21 enters the primary transfer nip of cyan image, which is set at a most upstream of primary transfer among four colors. The belt cleaning unit 26 can be contacted to the belt face 21*a* to clean toner remaining on the belt face 21*a* after a transfer.

FIG. 2 shows an expanded schematic view of the secondary transfer nip N and surrounding configuration of the transfer assembly 20 in the printing unit 100 for the image forming apparatus according to an example embodiment. As shown in FIG. 2, the secondary transfer-support roller 24, disposed inside the intermediate transfer belt 21, extends the intermediate transfer belt 21, by partially contacting with the outer surface of secondary transfer-support roller 24 on the intermediate transfer belt 21. The secondary transfer-support roller 24 may be used to maintain a shape of the intermediate transfer belt 21, which is deformable, by backing up the intermediate transfer belt 21 with the outer face of the secondary transfer-support roller 24 as such. Specifically, the secondary transfer-support roller 24 may maintain a curvature of the intermediate transfer belt 21 at a constant level. As such, the secondary transfer-support roller 24 may function as a backup roller of the intermediate transfer belt 21.

The secondary transfer roller 30 may contact the belt face 21*a* of the intermediate transfer belt 21 at a portion of the intermediate transfer belt 21, extended by the secondary transfer-support roller 24, to set the secondary transfer nip N.

The secondary transfer roller 30 may be rotatably supported by a roller supporting unit 40 using a support such as bearing. The roller supporting unit 40 includes a pivotable shaft 40*a*, extending in a direction parallel to a rotation shaft of the secondary transfer roller 30. The roller supporting unit 40 is pivotable about the pivotable shaft 40*a*. When the roller supporting unit 40 rotates in a counter-clockwise direction about the pivotable shaft 40*a* in FIG. 2, the secondary transfer roller 30 supported by the roller supporting unit 40 can be pressed against the intermediate transfer belt 21 to set the secondary transfer nip N. Further, when the roller supporting unit 40 rotates in a clockwise direction about the pivotable shaft 40*a* in FIG. 2, the secondary transfer roller 30 supported by the roller supporting unit 40 can be separated from the intermediate transfer belt 21.

In the transfer assembly 20, a spring 45 such as coil spring, used as a pressure device, constantly applies a force at an end portion 40*b* of the roller supporting unit 40, which is opposite to the pivotable shaft 40*a*, in a direction toward the intermediate transfer belt 21. By providing the spring 45 as such, a force, which can rotate the roller supporting unit 40 in a counter-clockwise direction about the pivotable shaft 40*a* in FIG. 2, can be constantly applied to the roller supporting unit 40, by which the secondary transfer roller 30 can be pressed toward the intermediate transfer belt 21.

The secondary transfer roller 30 may be rotated in a counter-clockwise direction in FIG. 2 using a driving force transmitted from a roller drive motor via a drive force transmission unit including a gear or the like. The roller drive motor and the drive force transmission unit may be supported by the roller supporting unit 40, and can pivot with the secondary transfer roller 30 and the roller supporting unit 40. Further, the roller supporting unit 40 may support a cleaning blade 39, a lubricant 41 such as solid lubricant, and a lubricant pushing unit 43.

The surface 30*a* of secondary transfer roller 30 may be used as a contact face 30*a* that contacts the belt face 21*a* of intermediate transfer belt 21 carrying toner images. Accordingly, toner on the belt face 21*a* may adhere onto the surface 30*a* (or contact face 30*a*) of secondary transfer roller 30. If such adhered toner is remained on the surface 30*a* of secondary transfer roller 30, such toner may be transferred to a back face of the recording medium P at the secondary transfer nip N, by which a contamination may occur on the back face of recording medium P. Accordingly, in the image forming apparatus, an edge of the cleaning blade 39 may be contacted to the surface 30*a* of secondary transfer roller 30 to remove toner from the surface of the secondary transfer roller 30 mechanically. In such a configuration, such contacting condition of the cleaning blade 39 may cause some load application that may inhibit a rotation of the secondary transfer roller 30. Therefore, the secondary transfer roller 30 may not be rotated using a movement of the intermediate transfer belt 21, but the secondary transfer roller 30 may be rotated by using a driving force of the roller drive motor as above mentioned.

The lubricant pushing unit 43 presses the lubricant 41 made of zinc stearate block or the like to the surface 30*a* of secondary transfer roller 30 using a coil spring 42. With such a configuration, lubricant such as lubricant powder can be applied on the surface 30*a* of secondary transfer roller 30. By applying the lubricant as such, an increase of rotation load and/or curling of blade edge caused by contacting the cleaning blade 39 to the surface 30*a* of secondary transfer roller 30 can be suppressed, in particular prevented. Further, instead of pressing the lubricant 41 to the surface 30*a* of secondary transfer roller 30, a rotatable application brush can be used to apply the lubricant 41 on the surface 30*a* of secondary transfer roller 30, in which lubricant is scraped from the lubricant 41 by the rotatable application brush, and then the rotatable application brush applies lubricant on the surface 30*a* of secondary transfer roller 30.

A description is now given to the transfer assembly 20 and image forming apparatus according to an example embodiment.

In a conventional apparatus, when the front edge of recording medium enters the secondary transfer nip N set between the belt face 21*a* of the intermediate transfer belt 21 and the surface 30*a* of secondary transfer roller 30, and when the rear edge of recording medium exits from the secondary transfer nip N, a shock impact may occur to the intermediate transfer belt 21, by which a speed fluctuation may occur to the intermediate transfer belt 21. Such speed fluctuation may become a problem, especially in light of an increased demand for image forming apparatuses to handle various types of recording media having various characteristics. For example, when the recording medium P is a thick sheet such as thick paper having a greater paper weight such as 300 g/m$^2$ or so, a shock impact at the secondary transfer nip N becomes greater, and thereby a shock jitter becomes a problem.

In example embodiment disclosed in this specification, while maintaining a transfer performance at a good enough level, an abrupt load fluctuation, which may occur at a moment when the front edge of recording medium P is transported to the secondary transfer nip N and at a moment when the rear edge of recording medium P exits from the secondary transfer nip N, can be reduced. Accordingly, a deterioration of image quality caused by misalignment of color images and/or misalignment of dot positions can be suppressed, in particular prevented, and an image having good enough quality can be obtained as below explained.

Figure 3:
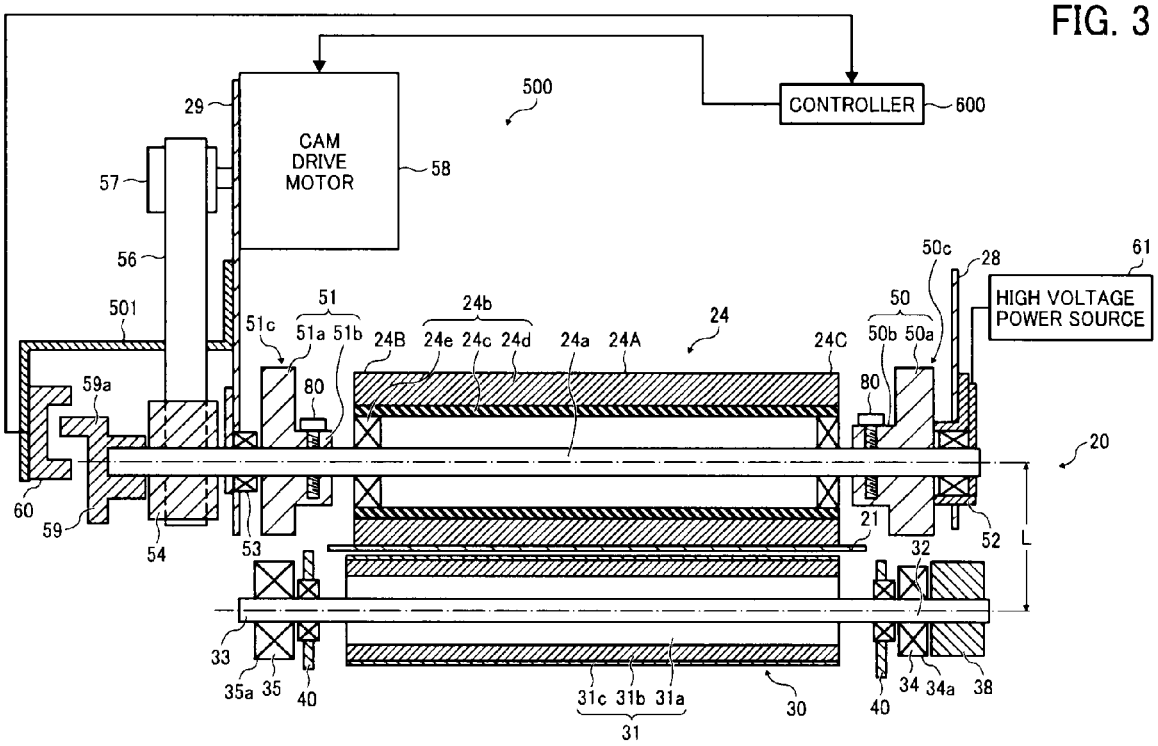
FIG. 3 shows an expanded cross-sectional view of transfer assembly viewed from a sheet transport direction.

FIG. 3 shows an expanded cross-sectional view of the secondary transfer nip N and surrounding configuration in the transfer assembly 20. As shown in FIG. 3, the secondary transfer roller 30 may include a roll 31, a shaft extending along the roll 31 and having a first shaft-end portion 32 and a second shaft-end portion 33, a first interface member 34, and a second interface member 35. The roll 31 extends in a direction, perpendicular to a transport direction of recording medium. Accordingly, the roll 31 extends in a width direction of recording medium. Each of the first shaft-end portion 32 and the second shaft-end portion 33 projects from each end of the roll 31 by extending in a rotation axial direction for some length. The first interface member 34 and the second interface member 35 will be described later.

The roll 31 may include a metal core 31*a*, an elastic layer 31*b*, and a surface layer 31*c*. The metal core 31*a* may be formed as a cylindrical shape such as hollow roll. The elastic layer 31*b*, made of elastic member, is fixed on an outer face of the metal core 31*a*. The surface layer 31*c* is fixed on an outer face of the elastic layer 31*b*.

The metal core 31*a* is made of metal such as stainless steel, aluminum, or the like, but not limited thereto. The elastic layer 31*b* may preferably have a given hardness such as JIS-A hardness of 70 degrees or less. However, because the cleaning blade 39 is contacted to the roll 31 of secondary transfer roller 30, some problems may occur if the elastic layer 31*b* is too soft. Therefore, the elastic layer 31*b* may preferably have a given hardness such as JIS-A hardness of 40 degrees or more. For example, the elastic layer 31*b* may be made of epichlorohydrin rubber having a given level of conductivity and JIS-A hardness of 50 degrees or so. As for rubber material having conductivity, in addition to the above mentioned epichlorohydrin rubber, carbon-dispersed ethylene propylene diene monomer (EPDM) or silicone (Si)-rubber, and rubber having ion conductive function such as nitril-butadiene rubber (NBR), urethane rubber, or the like can be used, but not limited thereto.

Because rubber material may generally exert a good level of chemical affinity and/or a relatively greater coefficient of friction with respect to toner, a surface of the elastic layer 31*b*, made of rubber material, may be coated by the surface layer 31*c* so that toner adhesion to the surface of secondary transfer roller 30 can be suppressed, and a scraping load between the cleaning blade 39 and the secondary transfer roller 30 can be reduced. The surface layer 31*c* may be preferably made of material having lower coefficient of friction and good level of toner separation performance such as for example fluoro resin mixed with resistance adjustment agent such as carbon, ion conductive agent, or the like.

When the secondary transfer roller 30 rotates while contacting the belt face 21*a* of intermediate transfer belt 21, the secondary transfer roller 30 and the belt face 21*a* may have a minute line speed difference each other, which may cause a slipping of belt. To prevent such slipping of belt, the coefficient of friction of surface layer 31*c* of secondary transfer roller 30 may be adjusted to a given value such as 0.3 or less. As for the intermediate transfer belt 21, to superimposingly transfer each of color images without causing color misalignment between each of color images, the intermediate transfer belt 21 may be required to be driven at a constant speed. Therefore, it is preferably to set the surface friction resistance of the surface layer 31*c* of secondary transfer roller 30 as small as possible. Such secondary transfer roller 30 can be pressed toward the intermediate transfer belt 21, extended by the secondary transfer-support roller 24, using the spring 45 (see FIG. 2).

The secondary transfer-support roller 24, extending the intermediate transfer belt 21 by applying a tension to the belt, may include a roll 24*b*, and a through-shaft 24*a*. The roll 24*b* is formed in a cylinder shape. The through-shaft 24*a*, disposed at the rotation axis position of the roll 24*b*, extends along the axial direction of the roll 24*b*, and both ends of through-shaft 24*a* project from both ends of the roll 24*b*. The roll 24*b* can rotate on the surface of through-shaft 24*a* without force transmission between the through-shaft 24*a* and roll 24*b*. The through-shaft 24*a*, made of metal, supports the roll 24*b*, and the roll 24*b* can freely or independently rotate on a face of the through-shaft 24*a* without force transmission between the through-shaft 24*a* and roll 24*b*.

The roll 24*b* may include a metal core 24*c*, an elastic layer 24*d*, and a bearing 24*e*. The metal core 24*c* has a drum shape such as a hollow roll. The elastic layer 24*d* made of elastic member is fixed on an outer surface of the metal core 24*c*. For example, the elastic layer 24*d* may be fixed on an outer surface of the metal core 24*c* using a pressure fitting. The bearing 24*e* may be fit at each end of the metal core 24*c* using, for example, by a pressure fitting. Accordingly, the bearing 24*e* supports the metal core 24*c*, and the metal core 24*c* and bearing 24*e* can rotate on a face of the through-shaft 24*a*.

The through-shaft 24*a* may be rotatably supported by a first bearing 52 and a second bearing 53 as shown in FIG. 3. The first bearing 52 is fixed at a first side plate 28 of the transfer assembly 20, and the second bearing 53 such as ball bearing is fixed at a second side plate 29 of the transfer assembly 20, wherein the intermediate transfer belt 21 may be extended using the transfer assembly 20. However, during a print job operation, the through-shaft 24*a* may not be driven or rotated most of the time but may be maintained at a stop condition. The roll 24*b* may not be rotated by a driver such as a drive motor, but can be rotated in a given direction when the intermediate transfer belt 21 moves endlessly. When the roll 24*b* rotates with a movement of the intermediate transfer belt 21, the roll 24*b*, supported on an outer face of the through-shaft 24*a*, can rotate on the through-shaft 24*a* without force transmission between and roll 24*b* and the through-shaft 24*a*.

The elastic layer 24*d* fixed on an outer face of the metal core 24*c* may be made of conductive rubber material having an adjusted resistance value by adding ion conductive agent. For example, a resistance value such as 7.5 (Log Ω) or more may be set for the elastic layer 24*d*. The electrical resistance of elastic layer 24*d* is adjusted in a given range to prevent concentration of transfer current at a contact portion between the belt face 21*a* and the surface of roller 31 when a relatively small-sized recording medium such as A5 size is used. When a relatively small-sized recording medium is used, the belt face 21*a* and the surface of roller 31 may directly contact each other at some portion in a roller axis direction at the secondary transfer nip N because the small-sized recording medium may not cover an entire area at the secondary transfer nip N. If the belt face 21*a* and the surface of roller 31 directly contact each other without a presence of the recording medium P, a concentration of transfer current at a contact portion between the belt face 21*a* and the roller surface 31 may occur. Such concentration of transfer current can be suppressed by setting an electrical resistance of the elastic layer 24*d* greater than an electrical resistance of the recording medium P.

The elastic layer 24*d* may be made of conductive rubber material such as foamed rubber, which can exert a given elasticity such as Asker-C hardness of 40 degrees or so. By configuring the elastic layer 24*d* using foamed rubber, the elastic layer 24*d* can be flexibly deformed in a thickness direction in the secondary transfer nip N. When the elastic layer 24*d* is deformed at the secondary transfer nip N, a given nip area can be set at the secondary transfer nip N in the transport direction of recording medium.

Specifically, the elastic layer 24*d* may be shaped in a drum-shape, in which an outside diameter at a center portion of elastic layer 24*d* is set greater than an outside diameter at both end portions of elastic layer 24*d*. As such, the secondary transfer-support roller 24 may be formed in a drum-shape, in which end portions 24B and 24C have an outside diameter smaller than an outside diameter at a center portion 24A.

When the secondary transfer roller 30 is pressed toward the intermediate transfer belt 21 using the spring 45 (see FIG. 2) to set the secondary transfer nip N, some deformation may occur to the roller, and a pressure level of the secondary transfer nip N at the center portion 24A of secondary transfer-support roller 24 may drop from an effective level.

The secondary transfer roller 30 is set at a given position in the transfer assembly 20 by supporting both end portions (used as supporting position) of the secondary transfer roller 30 such as both end portions of shaft of the secondary transfer roller 30. Similarly, the secondary transfer-support roller 24 is set at a given position in the transfer assembly 20 by supporting both end portions (used as supporting position) of the secondary transfer-support roller 24 such as both end portions of shaft of the secondary transfer-support roller 24.

When the secondary transfer roller 30 and the secondary transfer-support roller 24 are rotated during a transfer, a force is applied to the secondary transfer roller 30 at the secondary transfer nip. When such force becomes greater, the metal core of secondary transfer roller 30 and/or the metal core of secondary transfer-support roller 24 may be deformed, and a pressure difference may occur between the end portion and center portion of each of the rollers 30 and 24. Specifically, the center portion of the roller, which is most far from the supporting position of the roller, deforms greater than the end portion of roller. When such deformation occurs at the center portion of the roller, the transfer pressure at the secondary transfer nip may decrease to a level not effective for transfer. By forming the secondary transfer-support roller 24 as a drum-shaped roller as described above, such problem due to deformation can be suppressed, in particular prevented. Accordingly, when the secondary transfer roller 30 is pressed toward the intermediate transfer belt 21 using the spring 45, a drop of transfer pressure at the center portion 24A of secondary transfer-support roller 24 can be suppressed, in particular prevented.

Further, in the image forming apparatus, because the cleaning blade 39 may contact a face of the secondary transfer roller 30 as described above with reference to FIG. 2, it becomes hard to use material having a greater elasticity for a roller material of secondary transfer roller 30. Therefore, instead of the secondary transfer roller 30, the roll 24*b* of secondary transfer-support roller 24 may be made of material, which can effectively deform elastically.

As for the secondary transfer-support roller 24, the through-shaft 24*a* extends along the axial direction of secondary transfer-support roller 24, and each end portion of through-shaft 24*a* projects outside the roll 24*b*. Further, cam units 50 and 51 are fixed at each end portion of through-shaft 24*a*, by which the cam units 50/51 and the through-shaft 24*a* can be rotated integrally. The cam units 50 and 51 can be used as an abutting member that can abut with a member attached to the secondary transfer roller 30, and the cam units 50 and 51 may be one of components configuring an engagement/disengagement unit, to be described later. As shown in FIG. 3, the cam units 50 and 51 may not directly abut to the secondary transfer roller 30, but for the simplicity of expression, an expression such as "abutting the cam unit or cam to the secondary transfer roller 30" may be used in this disclosure. Specifically, as shown in FIG. 3, a first cam unit 50 is fixed at one end portion of the through-shaft 24*a*. The first cam unit 50 includes a cam 50*a* and a roll portion 50*b* shaped in a perfect circle, and the cam 50*a* and roll portion 50*b* are aligned in an axial direction, and may be formed as an integrated part. The first cam unit 50 may be fixed to the through-shaft 24*a* by screwing a screw 80 into a hole penetrating the roll portion 50*b* and a hole penetrating the through-shaft 24*a*. Similarly, a second cam unit 51 having a similar configuration of the first cam unit 50 may be fixed at other end portion of the through-shaft 24*a*.

Further, a drive force transmitting pulley 54 may be fixed to the through-shaft 24*a* at a portion in an axial direction of the through-shaft 24*a* such as for example at an outside of the second cam unit 51. Further, a detection disk 59 may be fixed to a shaft end of the through-shaft 24*a*, which is an outside of the drive force transmitting pulley 54, for example.

Further, a cam drive motor 58 is fixed and disposed, for example, at the second side plate 29 of the transfer assembly 20. The cam drive motor 58 may be used as a cam driver to drive and rotate the cam units 50 and 51 in a normal rotation direction and an inverse rotation direction. The cam drive motor 58 can rotate a motor pulley 57, disposed on an output shaft of the cam drive motor 58, and can transmit a drive force to the drive force transmitting pulley 54 fixed on the through-shaft 24*a* via a timing belt 56. With such a configuration, the through-shaft 24*a* can be rotated by activating the cam drive motor 58. Even when the through-shaft 24*a* is rotated by activating the cam drive motor 58, the roll 24*b* can freely rotate on the through-shaft 24*a* without force transmission between the through-shaft 24*a* and roll 24*b*. Accordingly, a rotation of through-shaft 24*a* may not effect or obstruct a rotation of the roll 24*b* following a movement of the intermediate transfer belt 21.

Further, when the cam drive motor 58 employs a stepping motor, a rotation angle detector such as encoder can be omitted, and a motor rotation angle can be set to an arbitrary value. Further, when a rotation angle detector is used, the rotation angle detector can be disposed to detect a rotation angle of the cam drive motor 58.

Further, the outer face 50*c* of cam 50*a* and the outer face 51*c* of cam 51*a* are formed in a given shape so that the cams 50*a* and 51*a* can be abutted to a member attached to the secondary transfer roller 30. As shown in FIG. 3, the first cam unit 50 and second cam unit 51 may not directly abut to the secondary transfer roller 30, but for the simplicity of expression, an expression such as "abutting the cam unit or cam to the secondary transfer roller 30" may be used in this disclosure. Specifically, when the through-shaft 24*a* stops its rotation at a given rotation angle, the cam 50*a* of first cam unit 50 and the cam 51*a* of second cam unit 51 can be abutted to the secondary transfer roller 30 to press the secondary transfer roller 30 against a force of the spring 45 applied to the roller supporting unit 40.

As such, by controlling a rotation position of the cam units 50 and 51, a position of the secondary transfer roller 30 can be adjusted, which means the shaft-to-shaft distance L between the secondary transfer-support roller 24 and the secondary transfer roller 30 can be adjusted. For example, the secondary transfer roller 30 can be moved toward nearby the secondary transfer-support roller 24 (or the intermediate transfer belt 21) by controlling a rotation position of the cam units 50 and 51. By adjusting the shaft-to-shaft distance L between the secondary transfer-support roller 24 and the secondary transfer roller 30, the clearance X, set between the surface 30*a* of secondary transfer roller 30 and the belt face 21*a* of intermediate transfer belt 21, at the secondary transfer nip N (see FIG. 3) can be adjusted. The clearance may be also referred to as gap.

In example embodiment, the shaft-to-shaft distance L between the secondary transfer-support roller 24 and the secondary transfer roller 30 can be adjusted by using at least the first cam units 50, the second cam unit 51, and the cam drive motor 58. Such first cam unit 50, second cam unit 51, and cam drive motor 58 may configure an engagement/disengagement unit 500, which can engage and disengage the surface 30*a* of secondary transfer roller 30 and the belt face 21*a* of intermediate transfer belt 21. When an engagement operation is conducted by the engagement/disengagement unit 500, the surface 30*a* of secondary transfer roller 30 and the belt face 21*a* of intermediate transfer belt 21 may be moved closer and pressed each other, and when an disengagement operation is conducted by the engagement/disengagement unit 500, the surface 30*a* of secondary transfer roller 30 and the belt face 21*a* of intermediate transfer belt 21 may move away each other.

As described above, the secondary transfer-support roller 24, used as a support member of the intermediate transfer belt 21, includes the roll 24*b* having a cylinder shape and the through-shaft 24*a* extending in the roll 24*b* and projecting from both end portions of the roll 24*b*, and the roll 24*b* can be freely rotated on the through-shaft 24*a* without force transmission between the through-shaft 24*a* and roll 24*b*.

When the through-shaft 24*a* rotates, the cam units 50 and 51 fixed at each end portion of the through-shaft 24*a* also rotate with the through-shaft 24*a*. Accordingly, the cam units 50 and 51, disposed at both end portions of the through-shaft 24*a*, can be rotated by using a driving force transmission mechanism disposed at only at one end portion in the axial direction of the through-shaft 24*a*, in which the driving force transmission mechanism transmits a driving force to the through-shaft 24*a*.

In the image forming apparatus, while the metal core 31*a* of secondary transfer roller 30 may be grounded or earthed, the metal core 24*c* of secondary transfer-support roller 24 may be applied with a secondary transfer bias voltage having the same polarity of toner. With such a configuration, in the secondary transfer nip N, a secondary transfer electric field, which can electrostatically move toner from a side of the secondary transfer-support roller 24 (i.e., intermediate transfer belt 21) toward a side of the secondary transfer roller 30, can be formed between the secondary transfer-support roller 24 and the secondary transfer roller 30.

Specifically, the first bearing 52, rotatably supporting the through-shaft 24*a* of secondary transfer-support roller 24, is made of metal and may be configured as a plain bearing having a given conductivity, for example. Such conductive first bearing 52 may be connected to a high voltage power source 61, which may be used to output a secondary transfer bias voltage. The secondary transfer bias voltage, output from the high voltage power source 61, is supplied to the secondary transfer-support roller 24 via the conductive first bearing 52. Then, in the secondary transfer-support roller 24, the secondary transfer bias voltage can be sequentially transmitted from the through-shaft 24*a* made of metal, the bearing 24*e* made of metal, the metal core 24*c* made of metal, and then to the conductive elastic layer 24*d*.

The detection disk 59 fixed at one end of the through-shaft 24*a* may include a detection member 59*a*, wherein the detection member 59*a* is formed at a given position of rotation direction of detection disk 59, and projects in the axial direction of the through-shaft 24*a*. Further, a sensor 60, which is an optical detector, is fixed to a sensor bracket 501 fixed to the second side plate 29 of the transfer assembly 20. When the through-shaft 24*a* is being in rotation, the through-shaft 24*a* rotates for a given rotation angle and comes to a given position, and then the detection member 59*a* of detection disk 59 comes to a position between a light emitting element and a light receiving element of the optical sensor 60, by which a light path between the light emitting element and light receiving element is blocked by the detection member 59*a*, and the optical sensor 60 can detect a timing when the light path between the light emitting element and light receiving element is blocked. Further, when the light receiving element receives light emitted from the light emitting element in the optical sensor 60, the light-receiving signal is transmitted to the controller 600.

The controller 600, which employs known computer and connected to the optical sensor 60 and the cam drive motor 58, may conduct followings. For example, the controller 600 detects a timing that the light-receiving signal from the light receiving element is not detected, computes a drive amount of the cam drive motor 58 based on such a timing that the receiving-light signal is not detected, activates the cam drive motor 58 based on the computed drive amount, and stops the cam units 50 and 51 at a given position such as a predetermined by detecting the rotation angle position of the cams 50*a* and 51*a* of cam units 50 and 51 fixed on the through-shaft 24*a*.

When the cam units 50 and 51 rotate for a given rotation angle, the cam units 50 and 51 can abut to the secondary transfer roller 30 to push down the secondary transfer roller 30 so as to move away from the secondary transfer-support roller 24 against a force of the spring 45. Hereinafter, such pushing down operation may be referred to as "pushing down." An amount of pushing down (hereinafter, may be referred to as "pushing down amount") can be determined based on a rotation angle position of the cam units 50 and 51. The greater the pushing down amount of the secondary transfer roller 30 by the cam units 50 and 51, the greater the shaft-to-shaft distance L between the secondary transfer-support roller 24 and the secondary transfer roller 30.

As for the secondary transfer roller 30, the first interface member 34 is attached to the first shaft-end portion 32 that rotates with the roll 31 integrally, in which the first interface member 34 can rotate on the first shaft-end portion 32 without force transmission between the first shaft-end portion 32 and the first interface member 34. The first interface member 34 may have a circular donut shape having a hole having a diameter slightly greater than an outside diameter of the roll 31. Specifically, the first interface member 34 may employ a ball bearing, for example, by which the first interface member 34 can rotate on an outer face of the first shaft-end portion 32 without force transmission between the first shaft-end portion 32 and the first interface member 34. As for the secondary transfer roller 30, the second interface member 35 is attached to the second shaft-end portion 33 as similar to the first interface member 34, in which the second interface member 35 can rotate on the second shaft-end portion 33 without force transmission between the second shaft-end portion 33 and the second interface member 35. The second interface member 35 may also be a ball bearing as similar to the first interface member 34.

As for the secondary transfer-support roller 24, the outer faces 50*c* and 51*c* of the cams 50*a* and 51*a* are formed into a given shape so that the cam units 50 and 51, fixed to the through-shaft 24*a*, can abut the first and second interface members 34 and 35 at a given rotation angle position of the cam units 50 and 51. Specifically, the cam 50*a* of first cam unit 50 fixed at one end of the through-shaft 24*a* abuts the first interface member 34 attached to the secondary transfer-support roller 24. At the same time, the cam 51*a* of second cam unit 51 fixed at other end of the through-shaft 24*a* abuts the second interface member 35 attached to the secondary transfer-support roller 24.

When each of the first and second interface members 34 and 35 is abutted by the cam units 50 and 51, a rotation of the first and second interface members 34 and 35 may be stopped by such abutting action, but a rotation of the secondary transfer roller 30 is not stopped by such abutting action. Specifically, a rotation of the first and second interface members 34 and 35 can be stopped by such abutting action. However, because each of the first and second interface members 34 and 35 may be a ball bearing, for example, the first shaft-end portion 32 and second shaft-end portion 33 of the secondary transfer roller 30 can freely and independently rotate with respect to the first and second interface members 34 and 35.

When the cams 50*a* and 51*a* abut the first and second interface members 34 and 35, a rotation of the first and second interface members 34 and 35 may be stopped, by which scraping between the cams 50*a*/51*a* and the first/second interface members 34/35 can be prevented. Further, because scraping between cams and interface members can be prevented as such, a torque increase of belt drive motor, and a torque increase of drive motor of secondary transfer roller 30 can be prevented.

A description is now given to a configuration and operation of the cam units 50 and 51 with reference to FIGS. 4 to 8. FIGS. 4 to 8 show example operation of cam units 50 and 51 when the recording medium P is a thick sheet such as for example thick paper. In example embodiment, each of the cam units 50 and 51 having the same shape and the same phase is disposed at each end of the through-shaft 24*a*. The controller 600 determines whether a thick sheet is used or not based on a sheet identification signal input to the controller 600, for example, from an operation unit of image forming apparatus such as copier. Then, based on the determination result of sheet type, the controller 600 controls an operation of the cam drive motor 58, by which position of the cam units 50 and 51 can be controlled.

Figure 4:
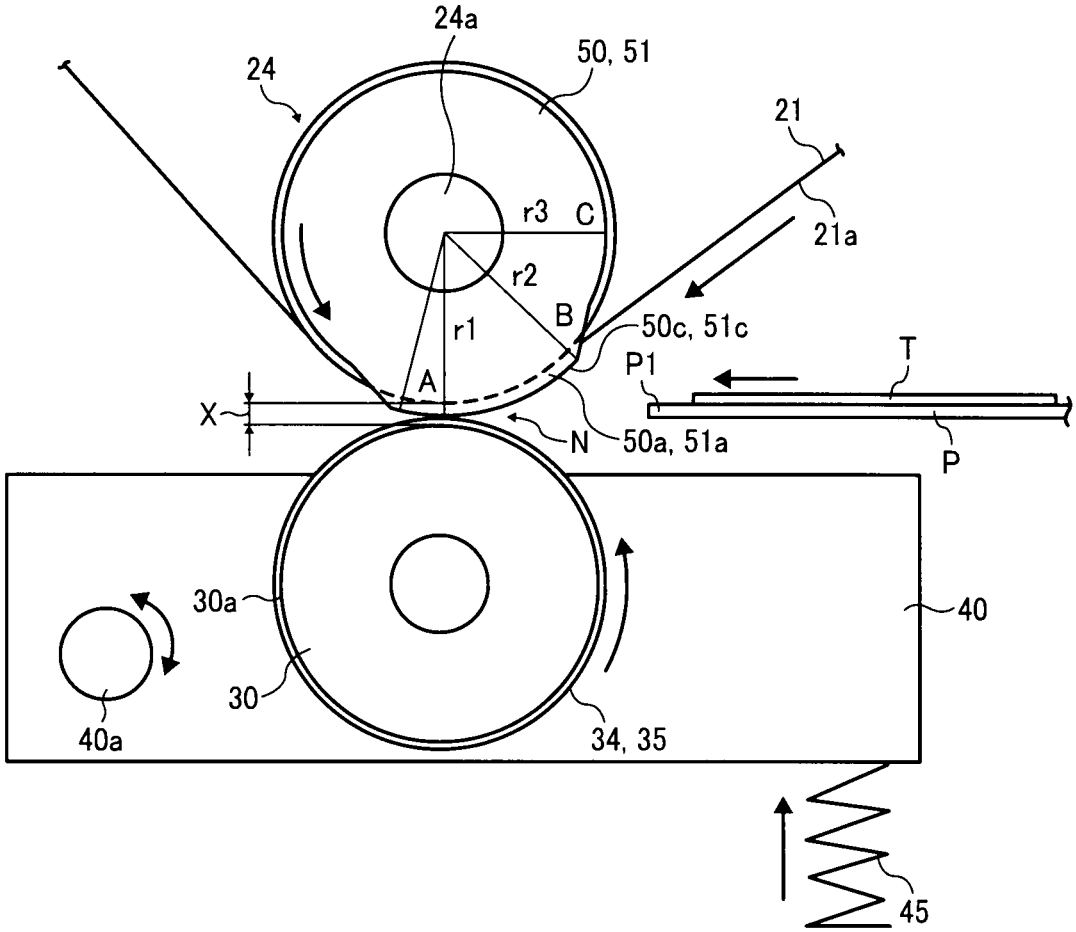
FIG. 4 shows an expanded cross-sectional view of transfer assembly before a recording medium enters a nip.

As for the cam units 50 and 51, each of the cams 50*a* and 51*a* has a first sector specified by such as A-to-B sector, and a second sector specified by such as C-to-A sector as shown FIG. 4, in which the first and second sectors can be distinguished by specifying different values for the radius r from the rotation center of the through-shaft 24*a*. For example, a first radius specifying the first sector is set greater than a second radius specifying the second sector. Specifically, as shown in FIG. 4, radius r1 and r2 of outer faces 50*c* and 51*c* in the first sector (i.e., A-to-B sector) have the same radius, and radius r3 of outer faces 50*c* and 51*c* in the second sector (i.e., C-to-A sector) is set smaller than the radius r1 and r2 (r3<r1, r2). Accordingly, the outer faces 50*c* and 51*c* specified by the A-to-B sector is set greater than the outer faces 50*c* and 51*c* specified by the C-to-A sector, which means the outer faces 50*c* and 51*c* specified by the A-to-B sector projects from the outer faces 50*c* and 51*c* specified by the C-to-A sector. As such, the first sector has a radius greater than a radius of the second sector of the cams 50*a* and 51*a*.

In the image forming apparatus, as shown in FIG. 4, before a sheet such as thick sheet or paper, used as recording medium P, enters the secondary transfer nip N, the cams 50*a* and 51*a* are abutted to the first and second interface members 34 and 35 at a first rotation position of the cams 50*a* and 51*a*, which is the cam position A, at which a rotation of the through-shaft 24*a* is stopped. In other words, when a thick sheet or paper is used as recording medium P, the controller 600 activates the cam drive motor 58 to change a phase of cam units 50 and 51 to conduct a pushing down operation of the secondary transfer roller 30 at the secondary transfer nip N, by which the clearance X having a given value can be set between the contact face 30*a* of secondary transfer roller 30 and the belt face 21*a* of intermediate transfer belt 21 at the secondary transfer nip N.

As such, by setting the clearance X between the contact face 30*a* of secondary transfer roller 30 and the belt face 21*a* of intermediate transfer belt 21 (or the secondary transfer-support roller 24) with a given value, even if the recording medium P having a greater thickness enters the secondary transfer nip N, an abrupt load fluctuation may not occur at the intermediate transfer belt 21 and/or the secondary transfer roller 30. Accordingly, a speed fluctuation of the intermediate transfer belt 21, which may occur when the front edge of recording medium P enters the secondary transfer nip N in a conventional apparatus, may not occur in the image forming apparatus according to an example embodiment, and thereby image failure such as abnormal image can be prevented.

If a thick sheet of paper or the like passes through the secondary transfer nip N with the secondary transfer roller 30 pushed down (i.e., when the clearance X is set), the probability of load fluctuation can be reduced and occurrence of shock jitter can be suppressed or prevented. However, with the secondary transfer roller 30 pushed down, the transfer pressure used for transfer may not be set to an effective level, by which transfer performance of transferring a toner image to a toner image area T on the recording medium P may deteriorate. The toner image area T is an area on the recording medium such as a sheet in which an image is formable. As such, the toner image area T may be an image forming area. In particular, when the recording medium P having a rough surface or at least a non-smooth surface is used, transfer performance may deteriorate significantly. Accordingly, when a thick sheet of paper is used as the recording medium P, the pushed-down secondary transfer roller 30 may need to be released (e.g., by pushing the secondary transfer roller 30 up) right after the recording medium P enters the secondary transfer nip N, by which an effective transfer pressure can be obtained at the secondary transfer nip N.

Usually, a blank margin is set from the front edge P1 of recording medium P to the front edge of the toner image area T. For example, the toner image area T may be defined by setting a 4 mm margin from the front edge P1 of recording medium P, although it should be noted that the margin can be set to any arbitrary value. Accordingly, to suppress deterioration of transfer performance on the recording medium P at and after the front edge of the toner image area T on the recording medium P, the pushed-down secondary transfer roller 30 needs to be pushed up until the margin (e.g., 4-mm margin) passes through the secondary transfer nip N (that is, until the front edge of the toner image area T reaches the secondary transfer nip N). In particular, the faster the printing speed, pushing-back of the secondary transfer roller 30 needs to be conducted within the shorter time period.

Figure 5:
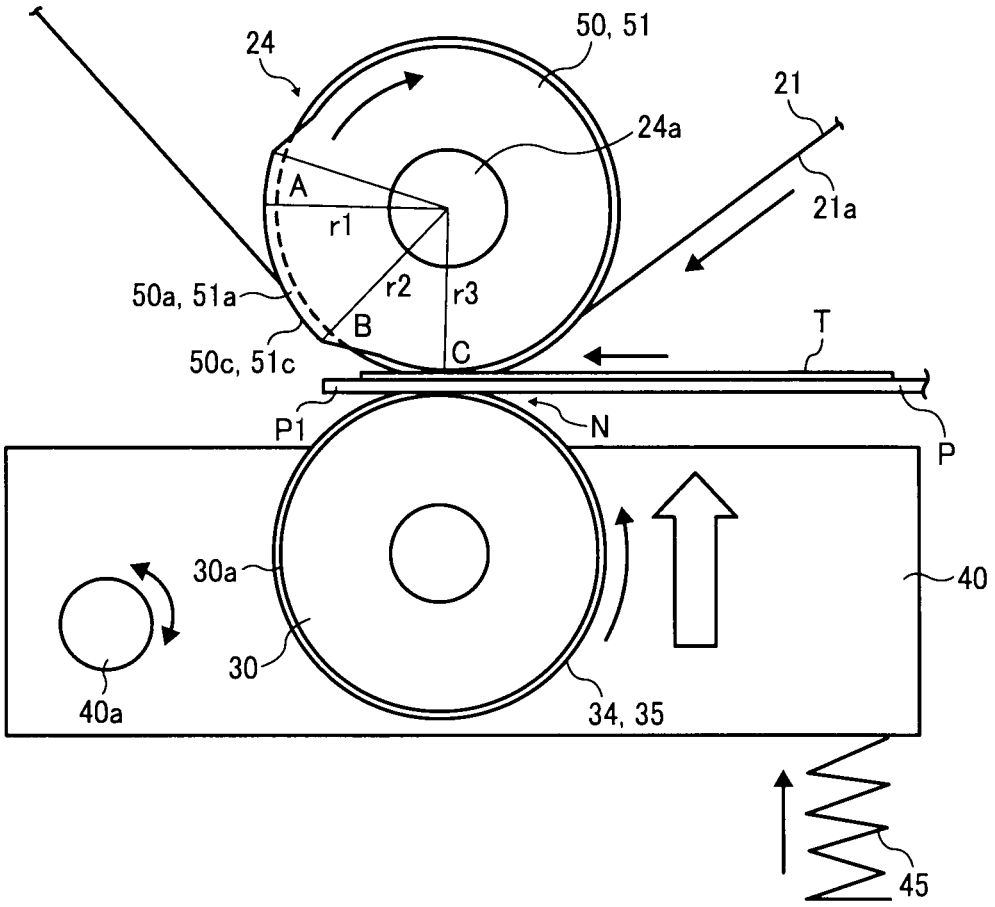
FIG. 5 shows an expanded cross-sectional view of transfer assembly when a recording medium is in a nip.

In example embodiment, a pushing-back operation such as pushing-up operation may be conducted as below explained with reference to FIG. 5. Specifically, a pushing-back operation may be conducted by moving the cam units 50 and 51 to a position that the cam units 50 and 51 does not abut at the first and second interface members 34 and 35 of the secondary transfer roller 30. More specifically, the cam drive motor 58 is activated to rotate the through-shaft 24*a* extending in the secondary transfer-support roller 24. Then, the cam units 50 and 51 can be rotated in a clockwise direction to a position that the cam units 50/51 and the first and second interface members 34/35 do not contact each other, and the cam units 50 and 51 is stopped at such second rotation position, which is the cam position C, so that the cam units 50 and 51 do not abut to the first and second interface members 34 and 35 during an image transfer. The phase of cam 50*a*/51*a* may be controlled as such to maintain the cam units 50 and 51 at a given position. The second rotation position of the cam units 50 and 51 corresponds to the second sector of the cams 50*a* and 50*b*.

By pressing the secondary transfer roller 30 to the intermediate transfer belt 21 via the recording medium P such as thick paper using a force of the spring 45, a transfer pressure can be increased compared to a condition at a timing when the recording medium P enters, by which an effective transfer pressure can be obtained during a transfer at the secondary transfer nip N, and resultantly an occurrence of transfer failure can be suppressed, in particular, prevented.

Accordingly, in an example embodiment, to complete such pushing-back operation such as pushing-up operation within a short time period, the cam drive motor 58 shown in FIG. 3 may be activated before a thick sheet enters the secondary transfer nip N, set between the secondary transfer roller 30 and the secondary transfer-support roller 24. Then, after starting an activation of the cam drive motor 58, the controller 600 controls a speed increase control for the cam drive motor 58. Specifically, the controller 600 controls a speed increase control until a rotation speed of the cam units 50 and 51 becomes a given speed, such as for example, a target speed for the cam drive motor 58, wherein the target speed may be a maximum speed.

Figure 6:
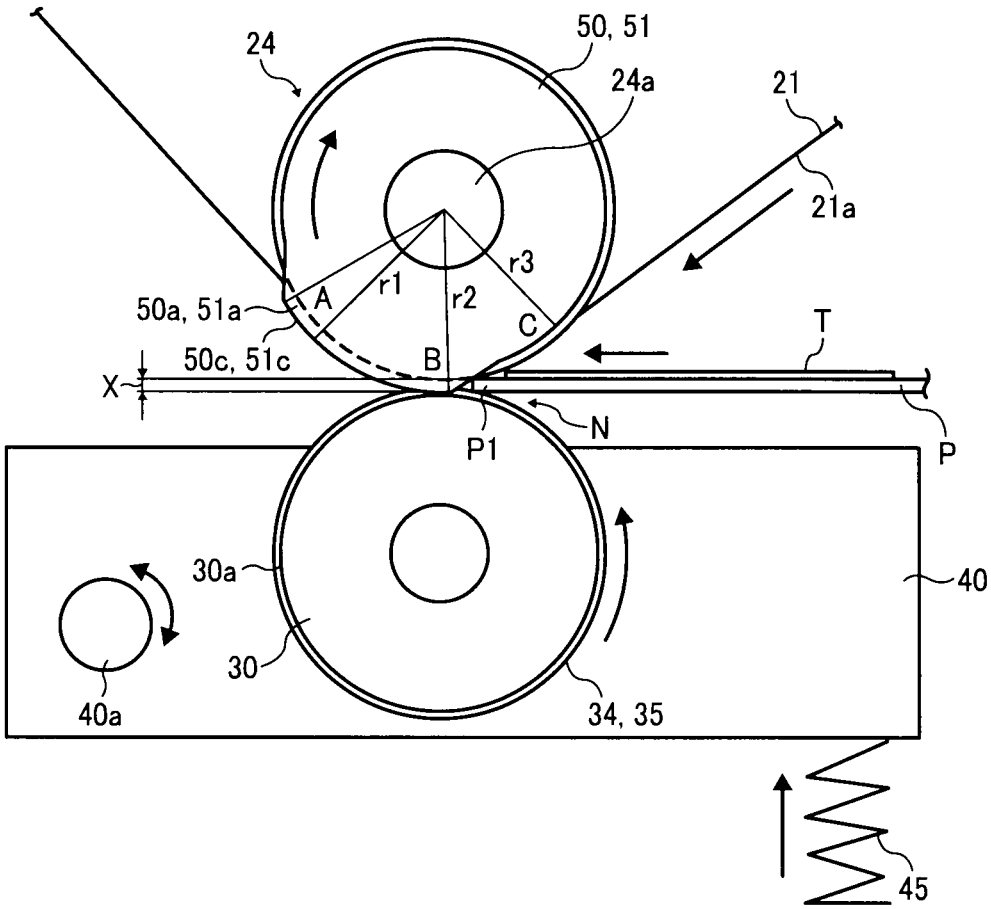
FIG. 6 shows an expanded cross-sectional view of transfer assembly when a recording medium is to enter a nip.

When such speed increase control is conducted, the cam units 50 and 51 can be rotated to a given position. As shown in FIG. 4, the cams 50*a* and 51*a* may abut to the first and second interface members 34 and 35 at the cam position A having radius r1 when the thick sheet is to enter the secondary transfer nip N, wherein the cam position A corresponds to the first rotation position or the first sector of the cams 50*a* and 51*a*. Then, as shown in FIG. 6, right after the thick sheet enters the secondary transfer nip N, the cams 50*a* and 51*a* may still abut to the first and second interface members 34 and 35 at the cam position B having radius r2, in which radius r1 and radius r2 have the same value (r1=r2). As such, because the first sector of outer faces 50*c* and 51*c* of cams 50*a* and 51*a* are formed by setting a condition of r1=r2, the clearance X, set between the contact face 30*a* of secondary transfer roller 30 and the belt face 21*a* of intermediate transfer belt 21 at the secondary transfer nip N, can be maintained at a given value constantly when the first sector of cam units 50 and 51 is set at the position as shown in FIGS. 4 and 6.

In an example embodiment, the outer faces 50*c* and 51*c* of the cams 50*a* and 51*a* have the first sector specified radius r1 and r2 having the same radius (r1=r2) to maintain a position of the secondary transfer roller 30 at a given position even when the cam units 50 and 51 rotate for some angle. Further the controller 600 controls a speed increase control for the cam drive motor 58 at a sector between the cam position B and the cam position C when to conduct a pushing back (or pushing up) of the secondary transfer roller 30.

As described above, the outer faces 50*c* and 51*c* of the cams 50*a* and 51*a* has the first sector (or A-to-B sector) specified by radius r1 and r2 having the same radius. For example, when the cams 50*a* and 51*a* is rotated for the first sector (or A-to-B sector), a rotation speed of the cams 50*a* and 51*a* can be increased by increasing a rotation speed of the cam drive motor 58 to a given level, such as for example, a maximum speed of the cam drive motor 58.

Further, a pushing-back operation of the secondary transfer roller 30 can be conducted by changing the position of the cams 50*a* and 51*a* from the cam position B to the cam position C. When the pushing-back operation is conducted, the clearance X, set between the surface 30*a* of secondary transfer roller 30 and the belt face 21*a* of intermediate transfer belt 21 (or the secondary transfer-support roller 24) becomes smaller, in particular becomes zero. If the cams 50*a* and 51*a* can be rotated from the cam position B to the cam position C with a faster speed such as a maximum speed of the cam drive motor 58, a pushing-back operation such as pushing-up operation can be completed within a shorter time period.

By conducting a speed increase control before the pushing-back operation is actually started, the pushing-back operation of the secondary transfer roller can be completed before the toner image area T comes to the secondary transfer nip N after the front edge P1 of recording medium P enters the secondary transfer nip N. However, at a moment when the secondary transfer roller 30 contacts the intermediate transfer belt 21, vibration may occur due to a shock impact caused by such contact action of the secondary transfer roller 30. The vibration caused by such contact action of secondary transfer roller 30 may be transmitted to a rotation movement (or rotation load) of the intermediate transfer belt 21, and further to a rotation movement of the photoconductors 2C, 2M, 2Y, 2K, by which uneven rotation at the photoconductors 2C, 2M, 2Y, 2K may occur, and thereby image failure such as abnormal image may resultantly occur.

In view of such vibration effect, in the image forming apparatus, the elastic layer 24*d* (see FIG. 3) of secondary transfer-support roller 24 may be made of foamed rubber having a small or low resilience, and a shape of secondary transfer-support roller 24 is formed as a drum-shape. Accordingly, when the secondary transfer roller 30 contacts the belt face 21*a*, all surfaces of secondary transfer roller 30 do not impact with the secondary transfer-support roller 24 at once, but the secondary transfer roller 30 may press different surface portions of the secondary transfer-support roller 24 with a given time lag. Further, a shock impact, which may occur when the secondary transfer roller 30 presses or contacts the secondary transfer-support roller 24, can be absorbed by elasticity of foamed rubber layer used for the elastic layer 24*d*.

However, vibration caused by a shock impact when the secondary transfer roller 30 presses or contacts the secondary transfer-support roller 24 may not be suppressed completely, and image failure such as abnormal image may be likely to occur. Accordingly, in an example embodiment, just before the outer faces 50*c* and 51*c* of cams 50*a* and 51*a* disengages from the outer faces 34*a* and 35*a* of first and second interface members 34 and 35, a rotation speed of cam units 50 and 51 is decreased to prevent an occurrence of abrupt change of transfer pressure by conducting a speed decrease control for the cam drive motor 58 using the controller 600. Specifically, when the pushing-back operation is conducted, a rotation speed of cam units 50 and 51 is decreased before the front edge of the toner image area T (or image forming area) comes to the secondary transfer nip N.

Figure 7:
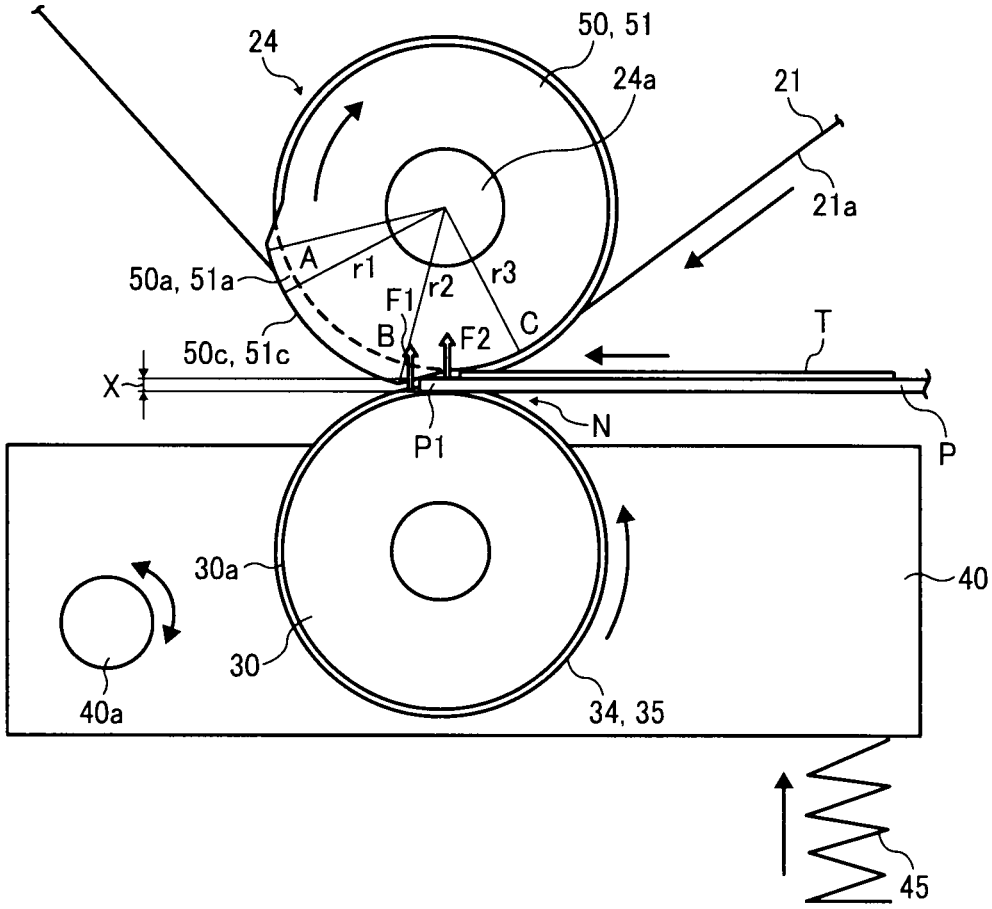
FIG. 7 shows an expanded cross-sectional view of transfer assembly for explaining a relation of clearance and transfer pressure when a recording medium is in a nip.

A description is given to the speed decrease control with reference to FIG. 7. In an example embodiment, during a pushing-back operation, a sector defined by from the cam position B to cam position C may be set as a speed decrease sector, and the cam units 50 and 51 may be rotated by decreasing the rotation speed. By rotating the cam units 50 and 51 as such, the clearance X may become zero. In such a situation, a force of the spring 45 may be decomposed to a contacting force F1, occurring between the first and second interface members 34/35 and the cams 50*a*/51*a*, and a transfer pressure F2, occurring between the secondary transfer roller 30 and the secondary transfer-support roller 24 via the recording medium P (thick sheet) and the intermediate transfer belt 21.

When the cams 50*a* and 51*a* further rotate and the cam position C comes to the secondary transfer nip N, the cams 50*a*/51*a* and the first and second interface members 34/35 do not contact each other, and then all of force of the spring 45 may be used as the transfer pressure F2.

An increase of the transfer pressure F2 within a short time period may cause a shock impact and resultant vibration, and may also increase a rotation load of the intermediate transfer belt 21. In view of such shock impact, a rotation speed of the cams 50*a* and 51*a* may be decreased just before separating or disengaging the cams 50*a* and 51*a* from the first and second interface members 34 and 35, by which the contacting force F1, occurring between the first and second interface members 34/35 and the cams 50*a*/51*a*, can be changed or shifted to the transfer pressure F2 gradually. Accordingly, the contacting force F1 can be changed or shifted to the transfer pressure F2 with a given time period, which may be relatively longer time. Such speed decrease control can be conducted by decreasing a rotation speed of the cam drive motor 58.

Figure 10:
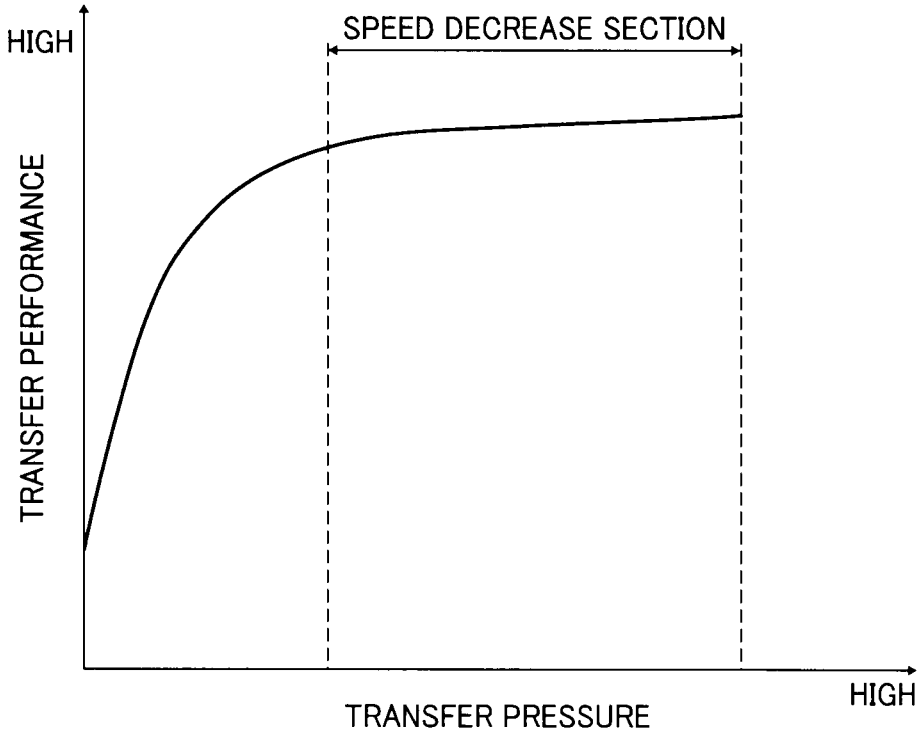
FIG. 10 shows a characteristic curve indicating a relation of transfer pressure and transfer performance.

When such speed decrease is conducted, a pushing-back of the secondary transfer roller 30 may not be completed from a time that the recording medium P (thick sheet) enters the secondary transfer nip N and a time that the toner image area T reaches the secondary transfer nip N. However, as shown in FIG. 10, a relationship between the transfer pressure and transfer performance is not a simple proportional relationship, but the transfer performance becomes a good enough level when the transfer pressure is increased to a given level or more. As such, the higher the transfer pressure, the better the transfer performance.

Accordingly, a deterioration of transfer performance when the front edge of the toner image area T enters the secondary transfer nip N can be suppressed by increasing a transfer pressure to a given level within a short time period before the toner image area T comes to the secondary transfer nip N. As shown in FIG. 10, when the transfer pressure is increased to a given level within a short time period before the toner image area T comes to the secondary transfer nip N, a deterioration of transfer performance can be suppressed. After then, the transfer pressure may be increased to a level that transfer performance is at a further good level, and the transfer pressure may be further increased to a highest level of transfer performance while decreasing a rotation speed of the cam units 50 and 51. With such configuration, a deterioration of transfer performance can be suppressed, in particular, prevented.

Figure 9:
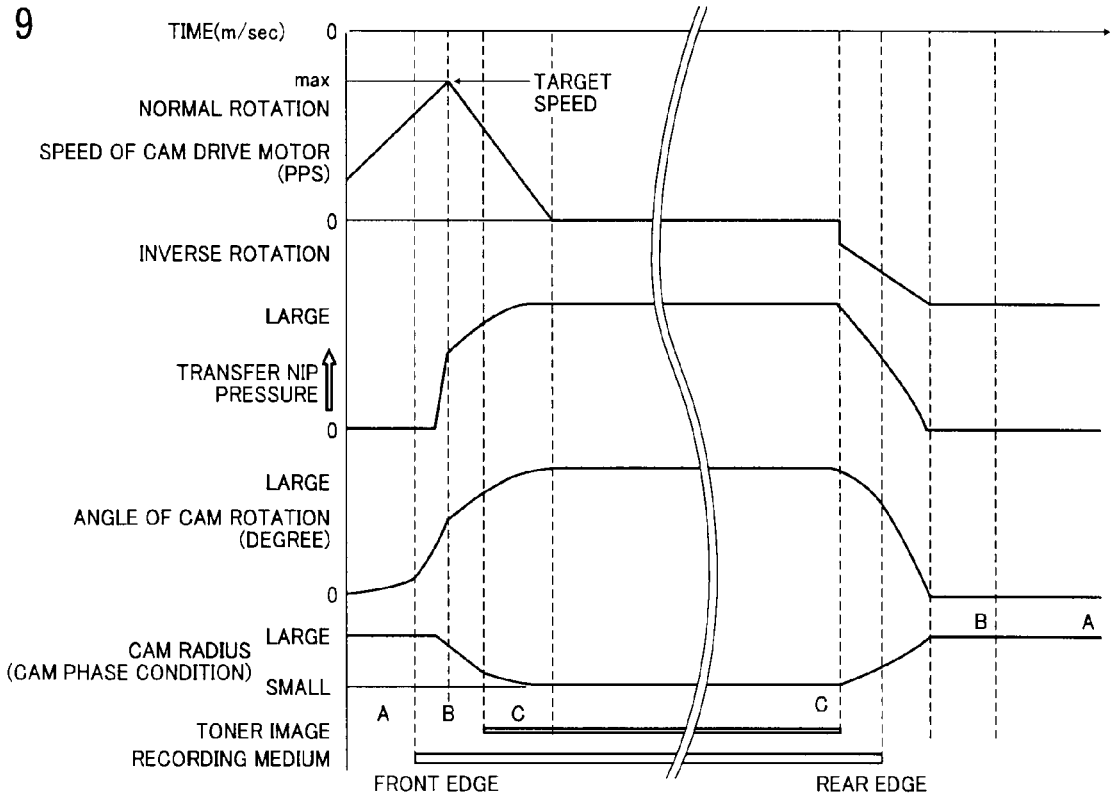
FIG. 9 shows a timing chart for a drive source, a cam, a recording medium, and an image transfer at a transfer assembly.

FIG. 9 shows a timing chart of several units around the secondary transfer nip N when a pushing-back operation of the secondary transfer roller 30 is conducted. FIG. 9 shows one example case that the cam drive motor 58 is controlled by a speed increase control, and right after such speed increase control, the cam drive motor 58 is controlled by a speed decrease control. In FIG. 9, the horizontal axis represents time, and the vertical axis represents change rate of each unit.

In this control process, the cam drive motor 58 is activated before the recording medium P comes to the secondary transfer nip N, and a rotation speed of the cam drive motor 58 is increased to a target speed, such as for example a maximum speed, within a short time period. This time period is a speed increasing period, in which the front edge P1 of recording medium P reaches to the secondary transfer nip N. During such speed-increasing period, the cam units 50 and 51 rotate while maintaining the clearance X at a given constant value, and the recording medium P enters the clearance X. The clearance X can be maintained at a constant level during such speed-increasing period because the outer faces 50*c* and 51*c* of cams 50*a* and 51*a* have the first sector having the radius r1, and such first sector has given area that the outer faces 50*c* and 51*c* of cams 50*a* and 51*a* can maintain a contact condition with the first and second interface members 34 and 35 when the cams 50*a* and 51*a* is being rotated.

At a timing when the recording medium P enters the secondary transfer nip N, a position of the secondary transfer roller 30 is started to change by changing a cam position of cams 50*a* and 51*a*, in which a position of the secondary transfer roller 30 can be changed using the cams 50*a* and 51*a* having different sectors having different radius. Specifically, as shown in FIG. 7, when a cam position of cams 50*a* and 51*a* is changed from the cam position B to the cam position C, the clearance X becomes substantiality zero, and a transfer pressure applied to the recording medium P can be increased. When the cam drive motor 58 is rotated at a target speed such as for example maximum speed, the cam units 50 and 51 can be rotated within a short time period, and the transfer pressure (or transfer nip pressure) can be increased rapidly as shown in FIG. 9.

When the toner image area T on the recording medium P comes to the secondary transfer nip N, the transfer pressure may not be yet increased to a highest level, but a good level of transfer performance can be exerted by the increased transfer pressure, and thereby deterioration of transfer performance may not be observed. Then, by conducting a speed decrease control for the cam drive motor 58, a rotation angle of the cam units 50 and 51 changes gradually, and the transfer pressure increases gradually.

In an example embodiment, the controller 600 may control a rotation speed of cam drive motor 58 when the recording medium P is to enter and enters the secondary transfer nip N, and may also control a rotation speed of cam drive motor 58 when the rear edge of recording medium P passes through or exits the secondary transfer nip N.

Figure 8:
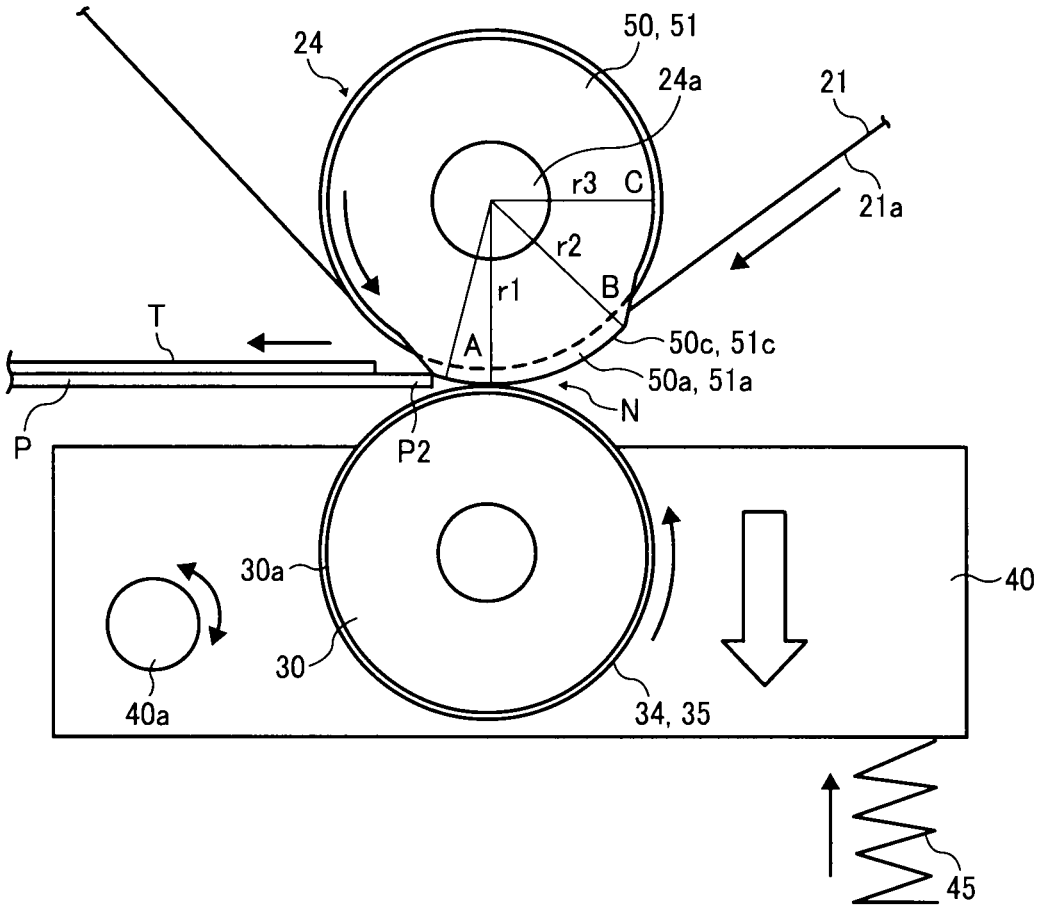
FIG. 8 shows an expanded cross-sectional view of transfer assembly when a recording medium exits from a nip.

Further, as shown in FIGS. 8 and 9, after transferring a toner image from the intermediate transfer belt 21 to the toner image area T, a given time period is required to pass through or exit the rear edge P2 of recording medium P from the secondary transfer nip N. During such time period, the cam units 50 and 51 may be operated in an inverse direction such as a rotation in a counter-clockwise direction, for example. In such a situation, the controller 600 controls the cam drive motor 58 to stop the outer faces 50*c* and 51*c* of cams 50*a* and 51*a* at the cam position A so that the outer faces 50*c* and 51*c* of cams 50*a* and 51*a* abut the first and second interface members 34 and 35. This operation may be effective for controlling load fluctuation.

An abrupt load fluctuation may occur at the intermediate transfer belt 21 and/or the secondary transfer roller 30 when the thick sheet is ejected from the secondary transfer nip N as similar when the front edge P1 of recording medium P enters the secondary transfer nip N. By conducting a pushing-down of the secondary transfer roller 30 by rotating the cam units 50 and 51 in an inverse direction, an abrupt load fluctuation at the intermediate transfer belt 21 and/or the secondary transfer roller 30 can be suppressed, in particular, prevented. Further, when such inverse rotation operation is conducted by rotating the cam units 50 and 51 from the second rotation position (cam position C) to the first rotation position (cam position A), a rotation speed of cam drive motor 58 can be increased to a faster speed, by which the clearance X can be set within a short time period, and thereby an occurrence of shock jitter can be suppressed, in particular, prevented.

When the rear edge of recording medium P passes through or exits the secondary transfer nip N, the cam drive motor 58 may be rotated in an inverse direction compared to when the recording medium P enters the secondary transfer nip N. Accordingly, a change of rotation direction (e.g., change to an inverse direction) occurs for the cam units 50 and 51 as shown in FIG. 9 compared to when the recording medium P enters the secondary transfer nip N. Further, because the cam units 50 and 51 rotate from the cam position C to the cam position A, the transfer pressure decreases gradually, in which a decrease rate of transfer pressure can be increased by conducting a speed increase control.

Figure 11:
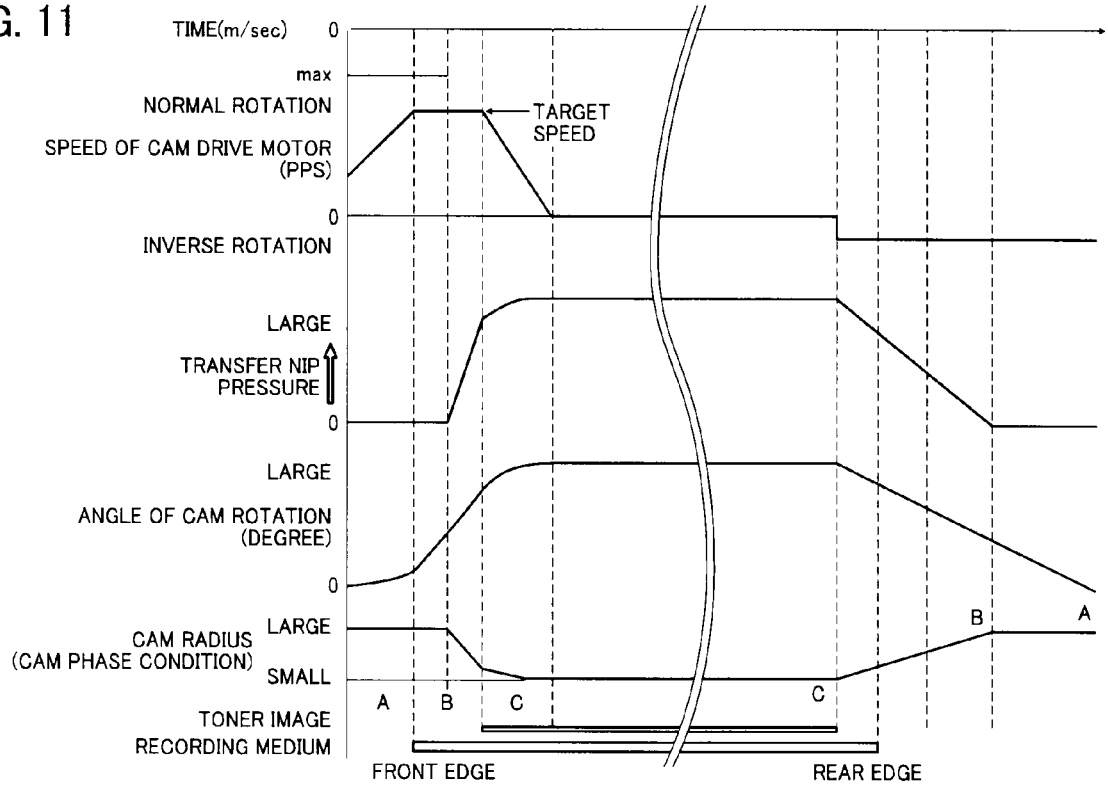
FIG. 11 shows another timing chart for a drive source, a cam, a recording medium, and an image transfer at a transfer assembly.

A description is now given to another control process of the controller 600 with reference to FIG. 11. In the above described control process described with reference to FIG. 9, when the front edge of recording medium P enters the secondary transfer nip N, and when the rear edge of recording medium P passes through or exits the secondary transfer nip N, a rotation speed of the cam drive motor 58 is increased to a given level, and then a speed decrease control is conducted immediately, by which shock impact (or collision) between the secondary transfer roller 30 and the intermediate transfer belt 21 is reduced.

In another example embodiment shown in FIG. 11, when the recording medium P enters the secondary transfer nip N, a rotation speed of the cam drive motor 58 is increased to a target rotation speed, and the target rotation speed is maintained for a given period, which may be referred to as constant speed period or speed maintaining period, and then a rotation speed of the cam drive motor 58 is decreased after such constant speed period or speed maintaining period ends.

With such a configuration, compared to decreasing a rotation speed of the cam drive motor 58 right after increasing the rotation speed, a load increase to the cam drive motor 58 and a drive system can be reduced, by which durability of units, devices, or apparatus can be enhanced. In particular, in example embodiments, because the screw 80 is fixed to the cam units 50 and 51, loosening may occur at a screw-fixed portion due to a load increase which may occur to a motor and a drive system. The control process shown in FIG. 11 can reduce such loosening at the screw-fixed portion, by which a phase deviation of cam can be suppressed, in particular prevented. Accordingly, both of shock jitter and transfer failure can be suppressed, in particular, prevented.

Further, in an example case of FIG. 11, when the rear edge P2 of recording medium P passes through or exits the secondary transfer nip N, a speed increase control may not be conducted.

If the secondary transfer roller 30 is pushed down against the transfer pressure when the rear edge P2 of recording medium P passes through or exits the secondary transfer nip N, a load increase at the cam drive motor 58 becomes greater. Because the higher the rotation speed of cam drive motor 58, the lower a motor torque, a high power motor may be required for conducting the pushing down of the secondary transfer roller 30, which means an increase in motor size. In view of reducing the size of the apparatus, it may be preferable not to conduct a speed control such as speed increase control when the rear edge P2 of recording medium p passes through the secondary transfer nip N.

The above-described image forming apparatus may be a copier, a facsimile machine, a printer, or a multi-functional apparatus, but not limited thereto. Further, the image forming apparatus may be a color forming apparatus, and single color image forming apparatus.

Further, in example embodiments, the recording medium P enters the secondary transfer nip N for transferring image on the recording medium P. Instead, the recording medium P can be transported to the primary transfer nip set between each of the photoconductors 2C, 2M, 2Y, 2K, and the primary transfer rollers 25C, 25M, 25Y, 25K via the intermediate transfer belt 21 for transferring image on the recording medium P, and the present invention can be applied to a transfer device to transfer a toner image from the photoconductors 2C, 2M, 2Y, 2K to the toner image area T of the recording medium P at the primary transfer nip with an effect similar to the above described effect.

In the above-described embodiments, the cam units 50 and 51, a support mechanism, and the cam drive motor 58 are provided for the secondary transfer-support roller 24, and the cam units 50 and 51 engages and disengages the secondary transfer roller 30 used as a counter member with respect to the secondary transfer-support roller 24. Instead, the cam units 50 and 51, a support mechanism, and the cam drive motor 58 can be provided for the secondary transfer roller 30, and the cam units 50 and 51 can engage and disengage the secondary transfer-support roller 24 with respect to the secondary transfer roller 30.

In the above-described embodiments, the high voltage power source 61 supplies a secondary transfer bias voltage to the secondary transfer-support roller 24, but the secondary transfer bias voltage can be supplied to the secondary transfer roller 30.

As described above, the transfer assembly according to example embodiments may include a counter member, an engagement/disengagement unit, a pressure device, a recording medium feed device, and a transfer device. The counter member, disposed opposite an image carrying face of an image carrying member, has a contact face to contact to a recording medium. The engagement/disengagement unit engages and disengages the image carrying face of the image carrying member and the contact face of the counter member. The engagement/disengagement unit includes a cam and a cam driver to drive and rotate the cam. The pressure device applies a force to a transfer nip defined between the image carrying face of the image carrying member and the contact face of the counter member in a state in which the image carrying face of the image carrying member engages the contact face of the counter member. The recording medium feed device feeds the recording medium to the transfer nip. The transfer device transfers an image from the image carrying member to the recording medium sandwiched at the transfer nip. The cam has an outer face having a given shape so that when the cam is at a first rotation position, the image carrying face of the image carrying member and the contact face of the counter member are separated, and when the cam is at a second rotation position, the image carrying face of the image carrying member and the contact face of the counter member contact each other. Before the recording medium, fed from the recording medium feed device, enters the transfer nip, the cam is started to rotate from the first rotation position toward the second rotation position at a given speed while increasing a rotation speed of the cam. After the recording medium enters the transfer nip, the cam is at the second rotation position to press the image carrying face of the image carrying member with the contact face of the counter member, and the force of the pressure device is applied to the transfer nip as a transfer pressure.

In the transfer assembly according to example embodiments, the rotation speed of the cam is decreased before a front edge of an image forming area defined on the recording medium, fed from the recording medium feed device, enters the transfer nip, and the image forming area is an area on the recording medium in which an image can be formed. With such a configuration, just before the counter member contacts or presses the image carrying member, the rotation speed of cam can be decreased, by which a shock impact which may occur when the counter member is pressed to the image carrying member, can be suppressed, in particular prevented.

In the transfer assembly according to example embodiments, the rotation speed of the cam is increased to a target rotation speed, maintained at the target rotation speed for a given time, and then decreased. With such a configuration, a rotation speed of the cam is not decreased right after a speed increase control, by which a load increase that may be occur to a drive system at a speed switching timing can be reduced, and thereby an occurrence of vibration due to an abrupt speed fluctuation can be suppressed, in particular prevented.

In the transfer assembly according to example embodiments, before the recording medium, which is fed from the recording medium feed device and enters the transfer nip, exits through the transfer nip, the cam starts to rotate from the second rotation position toward the first rotation position by increasing the rotation speed of the cam, and when the recording medium is to exit from the transfer nip, the cam is at the first rotation position to separate the contact face of the counter member from the image carrying face of the image carrying member so that the force of the pressure device is not applied to the transfer nip.

In the transfer assembly according to example embodiments, the first rotation position of the cam corresponds to a first sector of the cam specified by a first radius, and the second rotation position of the cam corresponds to a second sector of the cam specified by a second radius smaller than the first radius. When the cam is being moved from the first rotation position toward the second rotation position by increasing the rotation speed of the cam, the first sector of the cam is made to face the counter member to maintain a constant clearance between the image carrying face of image carrying member and the contact face of the counter member. With such a configuration, the first sector of the cam can be made to face the counter member until a rotation speed of cam becomes a target speed. Accordingly, a position of the counter member can be changed when the rotation speed of the counter member becomes an effectively higher speed, and a position of the counter member can be changed within a short time period.

In the transfer assembly according to example embodiments, the transfer assembly further includes a support member disposed opposite the counter member via the image carrying member to support the image carrying member from an opposite side of the image carrying face of the image carrying member, and the support member includes an elastic member of low resilience. With such a configuration, before the front edge of the recording medium enters a transfer nip defined between the image carrying member and the counter member, the counter member and the image carrying member can be set to a non-contact condition, by which a speed fluctuation of the image carrying member, which may occur when the front edge of recording medium enters the transfer nip, can be prevented, and thereby an image failure such as abnormal image can be prevented. Further, because the support member can be formed using an elastic member having low resilience, a shock impact, which may occur when the contact face of counter member presses the image carrying face of image carrying member when the front edge of recording medium enters, can be absorbed.

In the transfer assembly according to example embodiments, the transfer assembly further includes a support member disposed opposite the counter member via the image carrying member to support the image carrying member from an opposite side of the image carrying face of the image carrying member, and the support member includes a roll having a metal core, and a foamed rubber layer disposed on an outer face of the metal core. With such a configuration, when the contact face of counter member presses the image carrying face of image carrying member, an elastic deformation amount of support member can be set greater, by which a shock impact, which may occur when the contact face of counter member presses the image carrying face of image carrying member, can be absorbed.

In the transfer assembly according to example embodiments, the support member has a drum-shape, in which an outside diameter at each end portion of support member is smaller than an outside diameter at a center portion of support member. With such a configuration having different outside diameter at different portions on the support member, when the counter member presses the image carrying member and the support member, an entire area of the counter member may not press the image carrying member and the support member at once, but may press with some time lag, by which a shock impact can be further reduced. Specifically, because the outside diameter at center portion of support member is set greater than the outside diameter at end portion of support member, deformation of support member caused by a force of pressure device can be prevented, and thereby a drop of transfer pressure at the center portion of support member can be prevented.

In the transfer assembly according to example embodiments, the image carrying member is a belt having an elastic layer. With such a configuration, a shock impact, which may occur when the contact face of counter member presses the image carrying face of image carrying member, can be absorbed with the elastic layer of image carrying member.

Further, an image forming apparatus including the transfer assembly according to example embodiments can be devised.

In the above-described example embodiments, the engagement/disengagement unit engages and disengages the image carrying face of image carrying member and the contact face of counter member using the cam. The outer face of cam is formed in a given shape so that when the cam is at a first rotation position, the image carrying face of the image carrying member and the contact face of the counter member are separated, and when the cam is at a second rotation position, the image carrying face of the image carrying member and the contact face of the counter member contact each other. With such a configuration, a speed fluctuation of image carrying member, which may occur when the front edge of recording medium enters the transfer nip can be prevented, and thereby an image failure such as abnormal image can be prevented.

Further, in the above-described example embodiments, before the recording medium, fed from the recording medium feed device, enters the transfer nip, the cam is started to rotate from the first rotation position toward the second rotation position at a given speed while increasing the rotation speed of the cam. With such a configuration, a time of contacting the counter member to the image carrying member can be set to a short time period, and an effective transfer pressure can be secured before the front edge of image forming area defined on a sheet comes to the transfer nip, by which both of shock jitter and transfer failure can be suppressed, in particular, prevented.

Further, with such a configuration, a speed fluctuation of image carrying member, which may occur when the rear edge of recording medium passes through the transfer nip can be prevented, and thereby an image failure such as abnormal image can be prevented.

Further, in the above-described example embodiments, before the rear edge of recording medium passes through or exits the transfer nip, the cam is started to rotate from the second rotation position to the first rotation position while increasing the rotation speed of cam. With such a configuration, a time to separating the counter member from the image carrying member can be set to a short time period, and a shock jitter and a transfer failure can be suppressed, in particular, prevented.

In the above-described transfer assembly and image forming apparatus using the transfer assembly, both of shock jitter and transfer failure can be prevented, and an rotation load increase and/or vibration, which may occur when the counter member impacts the image carrying member, can be reduced, by which an image having good enough quality can be obtained.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A transfer assembly, comprising:

a counter member, disposed opposite an image carrying face of an image carrying member, the counter member having a contact face to contact to a recording medium;

an engagement/disengagement unit to engage and disengage the image carrying face of the image carrying member and the contact face of the counter member, the engagement/disengagement unit including a cam and a cam driver to drive and rotate the cam;

a pressure device to apply a force to a transfer nip defined between the image carrying face of the image carrying member and the contact face of the counter member in a state in which the image carrying face of the image carrying member engages the contact face of the counter member;

a recording medium feed device to feed the recording medium to the transfer nip; and a transfer device to transfer an image from the image carrying member to the recording medium sandwiched at the transfer nip, wherein the cam has an outer face having a given shape so that when the cam is at a first rotation position, the image carrying face of the image carrying member and the contact face of the counter member are separated, and when the cam is at a second rotation position, the image carrying face of the image carrying member and the contact face of the counter member contact each other, wherein before the recording medium, fed from the recording medium feed device, enters the transfer nip, the cam is started to rotate from the first rotation position toward the second rotation position at a given speed while increasing a rotation speed of the cam, wherein after the recording medium enters the transfer nip, the cam is at the second rotation position to press the image carrying face of the image carrying member with the contact face of the counter member, and the force of the pressure device is applied to the transfer nip as a transfer pressure, and wherein the rotation speed of the cam is decreased before a front edge of an image forming area defined on the recording medium, fed from the recording medium feed device, enters the transfer nip, the image forming area being an area on the recording medium in which an image can be formed.

2. The transfer assembly of claim 1, wherein the rotation speed of the cam is increased to a target rotation speed, maintained at the target rotation speed for a given time, and then decreased.

3. The transfer assembly of claim 1, wherein before the recording medium, which is fed from the recording medium feed device and enters the transfer nip, exits through the transfer nip, the cam starts to rotate from the second rotation position toward the first rotation position by increasing the rotation speed of the cam, and when the recording medium is to exit from the transfer nip, the cam is at the first rotation position to separate the contact face of the counter member from the image carrying face of the image carrying member so that the force of the pressure device is not applied to the transfer nip.

4. The transfer assembly of claim 1, wherein the first rotation position of the cam corresponds to a first sector of the cam specified by a first radius, and the second rotation position of the cam corresponds to a second sector of the cam specified by a second radius smaller than the first radius, wherein when the cam is being moved from the first rotation position toward the second rotation position by increasing the rotation speed of the cam, the first sector of the cam is made to face the counter member to maintain a constant clearance between the image carrying face of image carrying member and the contact face of the counter member.

5. The transfer assembly of claim 1, further comprising a support member disposed opposite the counter member via the image carrying member to support the image carrying member from an opposite side of the image carrying face of the image carrying member, and the support member including an elastic member of low resilience.

6. The transfer assembly of claim 1, further comprising a support member disposed opposite the counter member via the image carrying member to support the image carrying member from an opposite side of the image carrying face of the image carrying member, and the support member is a roll having a metal core, and a foamed rubber layer disposed on an outer face of the metal core.

7. The transfer assembly of claim 6, wherein the support member has a drum-shape, in which an outside diameter at each end portion of support member is smaller than an outside diameter at a center portion of support member.

8. The transfer assembly of claim 1, wherein the image carrying member is a belt having an elastic layer.

9. An image forming apparatus, comprising the transfer assembly of claim 1.

* * * * *